US008508561B2

(12) United States Patent
Yamazaki et al.

(10) Patent No.: US 8,508,561 B2
(45) Date of Patent: Aug. 13, 2013

(54) LIQUID CRYSTAL DISPLAY DEVICE AND ELECTRONIC DEVICE

(75) Inventors: Shunpei Yamazaki, Setagaya (JP); Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 214 days.

(21) Appl. No.: 13/079,035

(22) Filed: Apr. 4, 2011

(65) Prior Publication Data

US 2011/0249038 A1 Oct. 13, 2011

(30) Foreign Application Priority Data

Apr. 9, 2010 (JP) ..... 2010-090657

(51) Int. Cl.
*G09G 5/10* (2006.01)

(52) U.S. Cl.
USPC ..... 345/690; 345/88; 345/102; 349/61

(58) Field of Classification Search
USPC ..... 345/87, 88, 102, 690; 349/61–65; 340/815.55, 815.56
See application file for complete search history.

(56) References Cited

U.S. PATENT DOCUMENTS

| | | | | |
|---|---|---|---|---|
| 6,552,711 | B1 * | 4/2003 | Nakamura | 345/102 |
| 6,597,348 | B1 | 7/2003 | Yamazaki et al. | |
| 7,129,918 | B2 | 10/2006 | Kimura | |
| 7,145,536 | B1 | 12/2006 | Yamazaki et al. | |
| 7,317,438 | B2 | 1/2008 | Yamazaki et al. | |
| 7,385,579 | B2 | 6/2008 | Satake | |
| 7,674,650 | B2 | 3/2010 | Akimoto et al. | |
| 7,732,819 | B2 | 6/2010 | Akimoto et al. | |
| 7,738,055 | B2 | 6/2010 | Egi et al. | |
| 7,791,571 | B2 | 9/2010 | Ohtani et al. | |
| 2002/0085099 | A1 * | 7/2002 | Hirasawa et al. | 348/222 |
| 2005/0035939 | A1 * | 2/2005 | Akiyama | 345/102 |
| 2005/0231650 | A1 * | 10/2005 | Kobori et al. | 348/743 |
| 2006/0209002 | A1 | 9/2006 | Uchikawa | |
| 2006/0256257 | A1 * | 11/2006 | Nakano et al. | 349/80 |
| 2007/0108446 | A1 | 5/2007 | Akimoto | |
| 2007/0279374 | A1 | 12/2007 | Kimura et al. | |
| 2008/0079677 | A1 * | 4/2008 | Tai et al. | 345/88 |
| 2008/0284929 | A1 | 11/2008 | Kimura | |

(Continued)

FOREIGN PATENT DOCUMENTS

| | | | |
|---|---|---|---|
| JP | 2001-108961 | A | 4/2001 |
| JP | 2002-229021 | A | 8/2002 |

(Continued)

*Primary Examiner* — Joe H Cheng
(74) *Attorney, Agent, or Firm* — Eric J. Robinson; Robinson Intellectual Property Law Office, P.C.

(57) ABSTRACT

A liquid crystal display device by which a color moving image displayed with a field sequential system and a monochrome still image are switched and displayed. In a moving-image mode, a driving control circuit controls the backlight portion to emit light corresponding to any one of a plurality of colors of the first light source, and controls the display panel by writing of the image signal in the display panel for each of the plurality of colors within a predetermined period. In a still-image mode, the driving control circuit controls the backlight portion to keep the second light source emitting light, and controls the display panel to hold the image signal written thereto, for a predetermined period.

24 Claims, 12 Drawing Sheets

(56) References Cited

U.S. PATENT DOCUMENTS

| | | | | |
|---|---|---|---|---|
| 2008/0297676 | A1 | 12/2008 | Kimura | |
| 2008/0308805 | A1 | 12/2008 | Akimoto et al. | |
| 2008/0308806 | A1 | 12/2008 | Akimoto et al. | |
| 2009/0002586 | A1 | 1/2009 | Kimura | |
| 2009/0002597 | A1* | 1/2009 | Watanabe | 349/62 |
| 2009/0008639 | A1 | 1/2009 | Akimoto et al. | |
| 2009/0009455 | A1 | 1/2009 | Kimura | |
| 2009/0011611 | A1 | 1/2009 | Ichijo et al. | |
| 2009/0059107 | A1 | 3/2009 | Nagai et al. | |
| 2009/0109247 | A1* | 4/2009 | Kimura | 345/690 |
| 2009/0239335 | A1 | 9/2009 | Akimoto et al. | |
| 2009/0295839 | A1* | 12/2009 | Furukawa et al. | 345/690 |
| 2009/0303170 | A1* | 12/2009 | Chung et al. | 345/102 |
| 2009/0305461 | A1 | 12/2009 | Akimoto et al. | |
| 2010/0084651 | A1 | 4/2010 | Yamazaki et al. | |
| 2010/0136743 | A1 | 6/2010 | Akimoto et al. | |
| 2010/0155719 | A1 | 6/2010 | Sakata et al. | |
| 2011/0115839 | A1 | 5/2011 | Takahashi et al. | |
| 2011/0157216 | A1 | 6/2011 | Yamazaki et al. | |
| 2011/0157252 | A1 | 6/2011 | Yamazaki et al. | |
| 2011/0157253 | A1* | 6/2011 | Yamazaki et al. | 345/690 |
| 2011/0157254 | A1 | 6/2011 | Yamazaki et al. | |
| 2011/0267381 | A1* | 11/2011 | Yamazaki et al. | 345/690 |

FOREIGN PATENT DOCUMENTS

| | | |
|---|---|---|
| JP | 2003-248463 | 9/2003 |
| JP | 2003-248463 A | 9/2003 |
| JP | 2005-017493 A | 1/2005 |
| JP | 2005-190295 A | 7/2005 |
| JP | 2006-162680 A | 6/2006 |

* cited by examiner

LIQUID CRYSTAL DISPLAY DEVICE AND ELECTRONIC DEVICE

BACKGROUND OF THE INVENTION

1. Field of the Invention

The present invention relates to a liquid crystal display device. Further, the present invention relates to a method for driving a liquid crystal display device. Furthermore, the present invention relates to an electronic device including the liquid crystal display device.

2. Description of the Related Art

Liquid crystal display devices ranging from a large display device such as a television receiver to a small display device such as a mobile phone have been spreading. From now on, products with higher added values will be needed and are being developed. In addition, there has been a growing interest in global environment and the development of liquid crystal display devices consuming less power has thus attracted attention. Thus, a driving method called a field sequential driving method (hereinafter, a field sequential system) has been developed.

In the field sequential system, backlights of red (hereinafter, sometimes abbreviated to R), green (hereinafter, sometimes abbreviated to G), and blue (hereinafter, sometimes abbreviated to B) are switched within a predetermined period, and light of R, G, and B are supplied to a display panel. Therefore, a color filter is not necessarily provided for each pixel, and use efficiency of transmitting light from a backlight can be enhanced. Further, because one pixel can express R, G, and B, it is advantageous that improvement in definition is easily realized.

Patent Document 1 discloses a structure in which in order to achieve reduction in power consumption of a liquid crystal display device operated using the field sequential system, light sources corresponding to R, G, and B are used in displaying a color image and a light source corresponding to a single color (e.g., white (W)) is used in a monochrome image displaying a letter or the like.

Reference

[Patent Document 1] Japanese Published Patent Application No. 2003-248463

SUMMARY OF THE INVENTION

In the above Patent Document 1, a peripheral driver circuit is operated to control display even when a monochrome image displaying a letter or the like is displayed as a still image; therefore, power consumption is not low enough yet, which is a problem.

Thus, it is an object of an embodiment of the present invention to reduce power consumption in the event of displaying a color moving image or a monochrome still image as a result of switching the images.

According to one embodiment of the present invention, a liquid crystal display device includes a display panel, a backlight portion, an image switching circuit, and a driving control circuit. The backlight portion includes a first light source for emitting light with a plurality of colors for color display, and a second light source for emitting white light. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

According to one embodiment of the present invention, a liquid crystal display device includes a display panel, a backlight portion, an image switching circuit, and a driving control circuit. The display panel includes a plurality of pixels each of which has a pixel electrode configured to control alignment of liquid crystal and a transistor which is connected to the pixel electrode and includes an oxide semiconductor layer. The backlight portion includes a first light source including light sources for emitting light with a plurality of colors for color display, and a second light source for emitting white light. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

According to one embodiment of the present invention, a liquid crystal display device includes a display panel, a backlight portion, an image switching circuit, and a driving control circuit. The backlight portion includes a first light source including light sources corresponding to red, green, and blue and a second light source corresponding to white. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

According to one embodiment of the present invention, a liquid crystal display device includes a display panel, a backlight portion, an image switching circuit, and a driving control circuit. The display panel includes a plurality of pixels each of which has a pixel electrode for controlling alignment of liquid crystal, and a transistor connected to the pixel electrode and including an oxide semiconductor layer. The backlight portion includes a first light source including light sources corresponding to red, green, and blue, and a second light source including a light source corresponding to white. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

According to one embodiment of the present invention, a liquid crystal display device includes a display panel, a backlight portion, an image switching circuit, and a driving control circuit. The backlight portion includes a first light source including light sources corresponding to red, green, and blue, and a second light source including light sources corresponding to the blue and yellow. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

According to one embodiment of the present invention, a liquid crystal display device includes a display panel, a backlight portion, an image switching circuit, and a driving control circuit. The display panel includes a plurality of pixels each of which has a pixel electrode configured to control alignment of liquid crystal and a transistor which is connected to the pixel electrode and includes an oxide semiconductor layer. The backlight portion includes a first light source including light sources corresponding to red, green, and blue, and a second light source including light sources corresponding to the blue and yellow. The image switching circuit is configured to determine whether display is performed in a moving-image mode or a still-image mode in accordance with an image signal from the outside. In the moving-image mode, the driving control circuit is configured to control the backlight portion and the display panel by performing emitting light corresponding to any one of a plurality of colors of the first light source and writing of the image signal in the display panel for each of the plurality of colors within a predetermined period, so that a color image is perceived with a mixed color of the plurality of colors of the first light source. In the still-image mode, the driving control circuit is configured to control the backlight portion and the display panel by keeping light from the second light source emitting and holding the writing of the image signal in the display panel, for a predetermined period, so that a monochrome image are perceived.

One embodiment of the present invention may be a liquid crystal display device in which the second light source includes light sources corresponding to cyan and the red or light sources corresponding to magenta and the green.

One embodiment of the present invention may be a liquid crystal display device in which the first light source and the second light source are light-emitting diodes.

An embodiment of the present invention can achieve reduction in electric power consumed when a color moving image displayed with the field sequential system and a monochrome image are switched and displayed.

DETAILED DESCRIPTION OF THE INVENTION

Figure 1A:
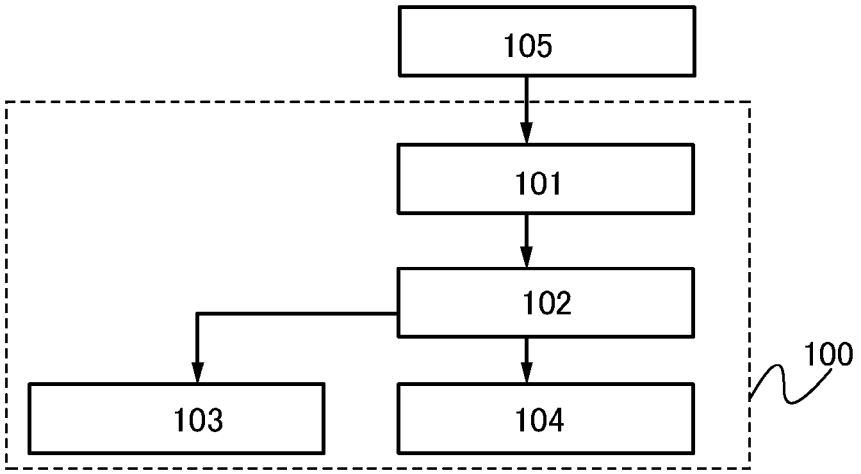
FIG. 1A is a block diagram.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore, this invention is not interpreted as being limited to the description of the embodiments below. Note that identical portions or portions having the same function in drawings illustrating the structure of the invention that are described below are denoted by the same reference numerals.

Note that the size, the thickness of a layer, the waveform of a signal, and a region of each structure illustrated in the drawings and the like in the embodiments are exaggerated for simplicity in some cases. Therefore, embodiments of the present invention are not limited to such scales.

Note that terms such as first, second, third to Nth (N is a natural number) employed in this specification are used in order to avoid confusion between components and do not set a limitation on number.

Embodiment 1

In this embodiment, a liquid crystal display device for selectively displaying a still-image mode and a moving-image mode is described with reference to FIG. 1A.

Note that in this specification, the still-image mode is a mode performed in case a liquid crystal display device determines image signals input to the liquid crystal display device as a still image, and the moving-image mode is a mode performed in case the liquid crystal display device determines the image signals input to the liquid crystal display device as a moving image.

A liquid crystal display device 100 in this embodiment includes an image switching circuit 101, a driving control circuit 102, a backlight portion 103, and a display panel 104.

The image switching circuit 101 is a circuit for determining whether an image signal from an image signal supply source 105 is displayed as a moving image (the moving-image mode) or as a still image (the still-image mode). For example, the moving-image mode and the still-image mode may be switched after whether a moving image or a still image is displayed is determined. Alternatively, the still-image mode and the moving-image mode may be switched in accordance with the kind of an inputted image signal. For example, the moving-image mode and the still-image mode may be switched with reference to a file format of electronic data which is a base of an image signal of the image signal supply source 105. Alternatively, the moving-image mode and the still-image mode may be switched in accordance with a switch signal from the outside of the image switching circuit 101. For example, the moving-image mode and the still-image mode may be switched by a switch, or the moving-image mode and the still-image mode may be switched in accordance with the amount of remaining electric power of a storage device such as a secondary battery.

Note that the image signal from the image signal supply source 105 is preferably a digital image signal. In the case of an analog image signal, an analog-digital converter may be provided between the image signal supply source 105 and the image switching circuit 101 to convert an analog value into a digital value.

The driving control circuit 102 generates and outputs a signal for controlling the backlight portion 103 and the display panel 104 in accordance with switching of the moving-image mode and the still-image mode in the image switching circuit 101. Specifically, the driving control circuit 102 controls the following: a signal for controlling on/off of a light source of the backlight portion 103, the frame frequency for displaying an image on the display panel 104, supply of an image signal, and supply of a signal for operating a driver circuit (e.g., a clock signal and a start pulse).

The backlight portion 103 includes a circuit for controlling a backlight and a plurality of light sources. The plurality of light sources are a first light source for performing display in the moving-image mode and a second light source for performing display in the still-image mode. The display panel 104 includes the driver circuit and a plurality of pixels. The pixel includes a transistor, a pixel electrode connected to the transistor, and capacitor. Note that the pixel electrode and an electrode paired with the pixel electrode have a liquid crystal layer therebetween, so that a liquid crystal element is formed.

Figure 1B:
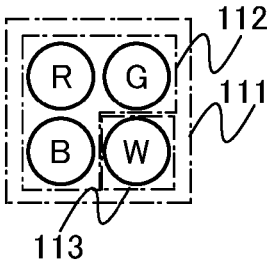
FIG. 1B is a schematic diagram.

FIG. 1B illustrates an example of the light source. A light source 111 illustrated in FIG. 1B has a first light source 112 and a second light source 113. The first light source 112 is used for a field sequential system to perform color display. A light source emitting light with a plurality of colors (here, red, green, and blue (RGB)) which can make a color image perceived with a use of field sequential system are used as the first light source 112. The second light source 113 performs monochrome display. A white (W) light source is used as the second light source 113.

Figure 1C:
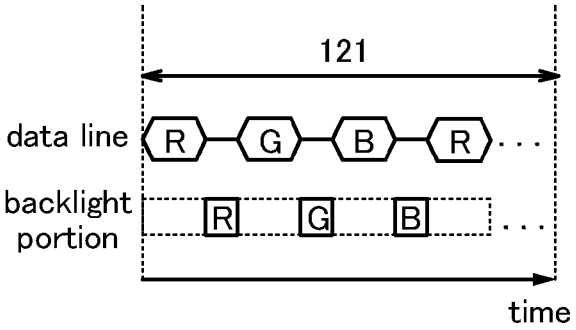
FIGS. 1C and 1D are timing charts of one embodiment of the present invention.
Figure 1D:
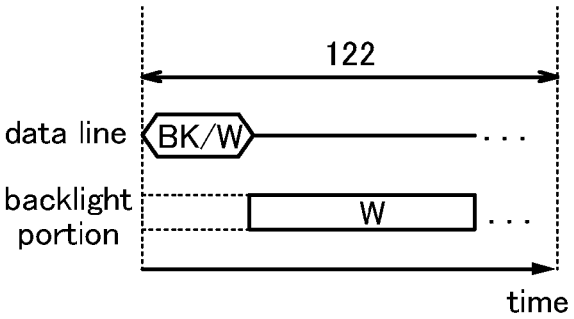

Then, operation of the driving control circuit 102 is described with reference to timing charts of FIGS. 1C and 1D. Note that the timing chart of FIG. 1C shows the case where the display panel 104 displays a color image, and simply illustrates timing of writing an image signal to a signal line (also referred to as a data line) of the display panel 104 and timing of turning on or off the light source of the backlight portion 103. Note that the timing chart of FIG. 1D shows the case where the display panel 104 displays a monochrome image, and simply illustrates timing of writing an image signal to the signal line (also referred to as the data line) of the display panel 104 and timing of turning on or off the light source of the backlight portion 103.

The timing chart of FIG. 1C shows operation in a first period 121 and the operation is in the moving-image mode. The timing chart of FIG. 1D shows operation in a second period 122 and the operation is in the still-image mode. The operation in this embodiment is roughly divided into the operations in the first period 121 and the second period 122.

Note that in the first period 121 in FIG. 1C, one frame period (or frame frequency) needed for writing image signals of RGB and lighting RGB is preferably 1/60 seconds or less (60 Hz or more). Note that display defects due to "color breaking" can be reduced when the frame frequency becomes high; the "color breaking" is a problem peculiar to the field sequential system. In the second period 122 in FIG. 1D, one frame period is extremely long, for example, longer than or equal to one minute (less than or equal to 0.017 Hz), so that eyestrain can be less severe compared to the case where the same image is switched plural times.

When an oxide semiconductor is used for a semiconductor layer of a transistor provided in each pixel of the display panel 104, off-state current of the transistor can be reduced. Accordingly, an electrical signal such as an image signal can be held for a longer period in the pixel, and a writing interval can be set longer. Therefore, one frame period can be longer, and the frequency of refresh operations can be reduced which correspond to operations of rewriting an image signal in the second period 122 in FIG. 1D; whereby the effect of suppressing power consumption can be enhanced. In a transistor including an oxide semiconductor, relatively high field-effect mobility can be obtained, whereby writing time can be shortened and high-speed operation needed in, for example, the field sequential system is possible.

In the first period 121 in FIG. 1C, the driving control circuit 102 supplies the following so that a color moving image is displayed with the field sequential system: image signals of RGB, a signal for operating the driver circuit (e.g., a clock signal and a start pulse), and a signal for controlling the backlight portion 103. Specifically, an image signal corresponding to an R (red) is written to the signal line so as to change the alignment of liquid crystal of each pixel. Successively, the driving control circuit 102 controls the backlight portion 103 so as to turn on an R backlight of the first light source. Successively, an image signal corresponding to a G (green) is written to the signal line so as to change the alignment of the liquid crystal of each pixel. Successively, the driving control circuit 102 controls the backlight portion 103 so as to turn on a G backlight of the first light source. Successively, an image signal corresponding to a B (blue) is written to the signal line so as to change the alignment of the liquid crystal of each pixel. Successively, the driving control circuit 102 controls the backlight portion 103 so as to turn on a B backlight of the first light source. An eye of a human perceives a color image through the above successive operations, and can perceive a moving image when the operations are repeated.

In the second period 122 in FIG. 1D, the driving control circuit 102 supplies the following so that a still image is displayed by the image signal for expressing a monochrome grayscale (denoted by BK/W in the figure): image signals of monochrome grayscale, a signal for operating the driver circuit (e.g., a clock signal and a start pulse), and a signal for controlling the backlight portion 103. Specifically, the image signal of monochrome grayscale is written to the signal line so as to change the alignment of liquid crystal of each pixel. Successively, the driving control circuit 102 controls the backlight portion 103 so as to turn on a W backlight of the second light source. After that, supply of the image signal of monochrome grayscale and the signal for operating the driver circuit (e.g., a clock signal and a start pulse) is stopped so that the alignment of the liquid crystal which is changed by the written image signal of monochrome grayscale is held. In the case where the W backlight of the second light source is kept on while the alignment is held, the display panel 104 can display a monochrome still image. When the driving control circuit 102 is stopped in the period other than the period of writing the image signal of monochrome grayscale, power consumption can be reduced. In the second period 122 in FIG. 1D, eyestrain can be less severe in comparison with the case where the same image signal is written plural times.

Figure 2A:
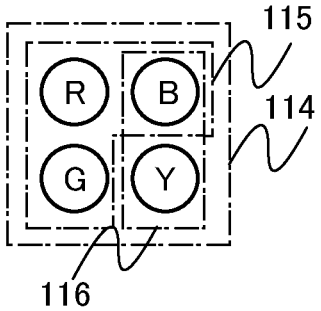
FIG. 2A is a schematic diagram and FIGS. 2B and 2C are timing charts of one embodiment of the present invention.

In FIG. 1B, a structure is described in which white (W) is used as a color of the light source in addition to red, green, and blue (RGB); however, another structure can be used. FIG. 2A illustrates a structure different from that in FIG. 1B. A light source 114 illustrated in FIG. 2A has a first light source 115 and a second light source 116. The first light source 115 is used for the field sequential system to perform color display, as in FIG. 1B. A light source emitting light with a plurality of colors (here, red, green, and blue (RGB)) which can make a color image perceived with a use of field sequential system is used as the first light source 115. The second light source 116 performs monochrome display, as in FIG. 1B. As the second light source 116, a light source which can express white by turning on light sources of blue (B) and yellow (Y) at the same time. Note that a structure in which yellow, a complementary color of blue, is used for the second light source for expressing white is advantageous over low power consumption and the like in comparison with the structure in which white is expressed by lighting RGB at the same time.

Figure 2B:
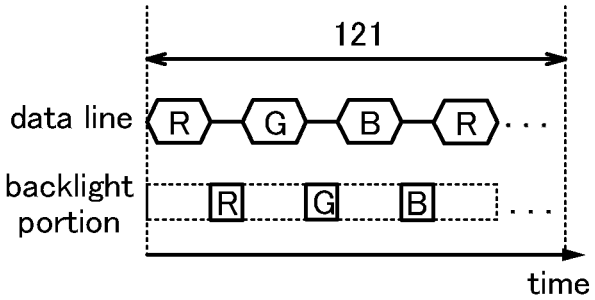

Then, operation of the driving control circuit 102 in the case of using the light source 114 in FIG. 2A is described with reference to timing charts of FIGS. 2B and 2C. Note that as in FIG. 1C, the timing chart of FIG. 2B shows the case where the display panel 104 displays a color image, and simply illustrates timing of writing an image signal to the signal line (also referred to as a data line) of the display panel 104 and timing of turning on or off the light source of the backlight portion 103. Note that as in FIG. 1D, the timing chart of FIG. 2C shows the case where the display panel 104 displays a monochrome image, and simply illustrates timing of writing an image signal to the signal line (also referred to as a data line) of the display panel 104 and timing of turning on or off the light source of the backlight portion 103.

Figure 2C:
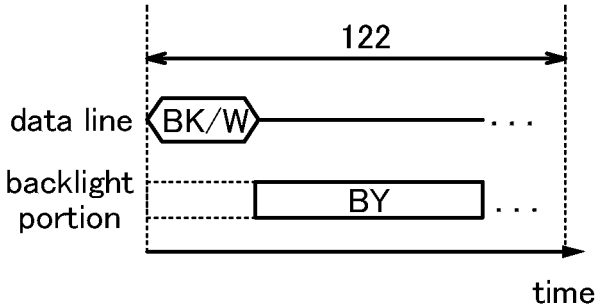

The operation in the timing charts of FIGS. 2B and 2C, as of FIGS. 1C and 1D, is roughly divided into the operations in the first period 121 and the second period 122.

In the first period 121 in FIG. 2B, the operation similar to that described with reference to FIG. 1C is performed, so that an eye of a human perceives a color image and can perceive a moving image when the operations are repeated.

In the second period 122 in FIG. 2C, as in FIG. 1D, the driving control circuit 102 supplies the following so that a still image is displayed by the image signal for expressing a monochrome grayscale (denoted by BK/W in the figure), a signal for operating the driver circuit (e.g., a clock signal and a start pulse), and a signal for controlling the backlight portion 103. Specifically, the image signal of monochrome grayscale is written to the signal line so as to change the alignment of a liquid crystal of each pixel. Successively, the driving control circuit 102 controls the backlight portion 103 so as to turn on blue (B) and yellow (Y) backlights of the second light source. After that, as in FIG. 1D, supply of the image signal of monochrome grayscale and the signal for operating the driver circuit (e.g., a clock signal and a start pulse) is stopped so that the alignment of the liquid crystal is held which is changed by the written image signal of monochrome grayscale. In the case where the blue (B) and yellow (Y) backlights of the second light source is kept on while the alignment is held, the display panel 104 can display a monochrome still image. When the driving control circuit 102 is stopped in the period other than the period of writing the image signal of monochrome grayscale, power consumption can be reduced, as in FIG. 1D. In the second period 122, eyestrain can be less severe in comparison with the case where the same image signal is rewritten plural times.

Note that in FIGS. 2A to 2C, the structure is described in which yellow, a complementary color of blue, is used for the second light source for expressing white; however, another structure can be used for obtaining a white light source. For example, white expressed by the use of magenta, a complementary color of green, may be used for the second light source. Further, white expressed by the use of cyan, a complementary color of red, may be used for the second light source.

Figure 3:
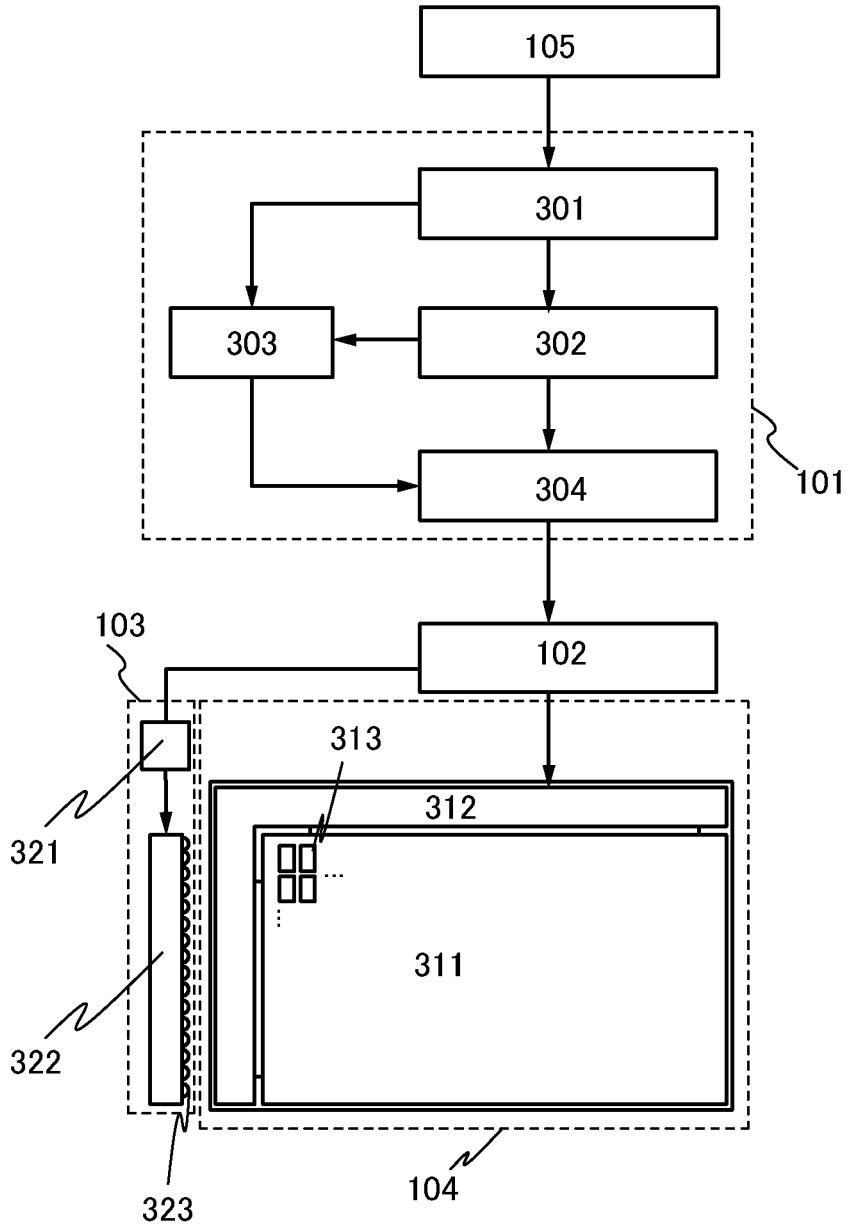
FIG. 3 is a block diagram of one embodiment of the present invention.

Next, a specific example is illustrated in FIG. 3 to describe the structures of the image switching circuit 101, the backlight portion 103, and the display panel 104. Note that the following structure is described with reference to FIG. 3: images of sequential frames are compared to judge whether a moving image or a still image is to be displayed, and the moving-image mode and the still-image mode are selected.

The image switching circuit 101 in FIG. 3 includes a memory circuit 301, a comparison circuit 302, a selection circuit 303, and a display control circuit 304.

The backlight portion 103 includes a backlight control circuit 321 and a backlight 322. Light sources 323 are arranged in the backlight 322.

The backlight 322 is provided to be next to the display panel 104 in FIG. 3, but the backlight 322 may be overlapped with the display panel 104. Color combination of the light source 323 can be the color combinations illustrated in FIG. 1B and FIG. 2A. Note that the life of the light source 323 can be longer with the use of a light-emitting diode as the light source 323. Further, in the case where the backlight 322 are formed by combination of the light source 323 and a light guide plate, the number of the light sources 323 can be reduced; therefore, reduction in cost can be achieved.

The display panel 104 includes a pixel portion 311 and a driver circuit 312. In the pixel portion 311, a plurality of pixels 313 each connected to a scan line and a signal line are arranged in matrix.

The pixel 313 includes a transistor, a pixel electrode connected to the transistor, and a capacitor. A liquid crystal layer is provided between the pixel electrode (a first electrode) and a counter electrode (a second electrode) faced to the pixel electrode, so that a liquid crystal element is formed.

An example of liquid crystal elements is an element which controls transmission and non-transmission of light by optical modulation action of liquid crystals. The element can include a pair of electrodes and liquid crystals. The optical modulation action of liquid crystals is controlled by an electric field applied to the liquid crystals (that is, a vertical electric field). Specifically, the following can be used for a liquid crystal, for example: a nematic liquid crystal, a cholesteric liquid crystal, a smectic liquid crystal, a discotic liquid crystal, a thermotropic liquid crystal, a lyotropic liquid crystal, a low-molecular liquid crystal, a polymer dispersed liquid crystal (PDLD), a ferroelectric liquid crystal, an anti-ferroelectric liquid crystal, a main-chain liquid crystal, a side-chain high-molecular liquid crystal, and a banana-shaped liquid crystal. In addition, the following can be used as a driving method of a liquid crystal: a TN (twisted nematic) mode, an STN (super twisted nematic) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a PNLC (polymer network liquid crystal) mode, a guest-host mode, and the like.

Note that the driving control circuit 102 in FIG. 3 outputs a signal for controlling the backlight control circuit 321 of the backlight portion 103 and a signal for controlling the driver circuit 312 of the display panel 104, in accordance with a signal from the image switching circuit 101.

Here, operation of a structure in FIG. 3 is described.

An image signal is input from the image signal supply source 105 to the image switching circuit 101. The memory circuit 301 includes a plurality of frame memories for storing image signals for a plurality of frames. The number of frame memories included in the memory circuit 301 is not particularly limited as long as the image signals for a plurality of frames can be stored. Note that the frame memory may be formed using a memory element such as dynamic random access memory (DRAM) or static random access memory (SRAM).

Note that the number of frame memories is not particularly limited as long as an image signal can be stored for each frame period. The image signals stored in the frame memories are selectively read out by the comparison circuit 302 and the selection circuit 303.

The comparison circuit 302 is a circuit that selectively reads out image signals in successive frame periods stored in the memory circuit 301, compares the image signals in the successive frame periods in each pixel, and detects a difference thereof.

Depending on whether a difference is detected, operations in the display control circuit 304 and the selection circuit 303 are determined. When a difference is detected in any of the pixels by comparing the image signals in the comparison circuit 302, a series of frame periods during which the difference is detected are judged as periods during which a moving image is displayed. On the other hand, when a difference is not detected in all the pixels by comparing the image signals in the comparison circuit 302, a series of frame periods during which no difference is detected are judged as periods during which a still image is displayed. In other words, depending on whether a difference is detected by the comparison circuit 302, whether the image signals in the successive frame periods are image signals for displaying a moving image or image signals for displaying a still image is determined by the comparison circuit 302.

Note that the difference obtained by the comparison may be set to be detected when the difference exceeds a certain level. The comparison circuit 302 may be set so as to judge detection of differences by the absolute values of the differences.

Note that by switching of a plurality of images which are time-divided into a plurality of frames at high speed, the images are recognized as a motion image by human eyes. Specifically, by switching of images at least 60 times (60 frames) per second, the images are recognized as a moving image with fewer flickers by human eyes. In contrast, unlike a moving image, a still image refers to image signals which do not change in successive frame periods, for example, in an n-th frame and an (n+1)th frame though a plurality of images which are time-divided into a plurality of frame periods are switched at high speed.

The selection circuit 303 includes a plurality of switches such as a switch formed using a transistor. When the difference is detected by calculation in the comparison circuit 302, that is, when an image displayed in the series of frames is a moving image, the selection circuit 303 is a circuit for selecting the image signals from the frame memories in the memory circuit 301 in which the image signal is stored, and for outputting the image signals to the display control circuit 304.

Note that the selection circuit 303 does not output the image signals to the display control circuit 304 when a difference between the image signals is not detected by calculation with the comparator circuit 302, that is, when images displayed in successive frame periods are still images. When a still image is displayed, the selection circuit 303 does not output image signals from the frame memory to the display control circuit 304, resulting in a reduction in power consumption.

The display control circuit 304 outputs an image signal selected in the selection circuit 303 in accordance with detection of difference in the comparison circuit 302 and a signal for determining whether the moving-image mode or the still-image mode is driven, to the driving control circuit 102. For example, the driving control circuit 102 controls and switches the light source of the backlight portion 103 to be turned on/off and operation of the driver circuit of the display panel 104 to be in the moving-image mode or the still-image mode as in FIG. 1C or FIG. 2B, in accordance with a signal, which is output from the display control circuit 304 of the image switching circuit 101, for determining whether the moving-image mode for displaying a moving image or the still-image mode for displaying a still image is driven.

Figure 4:
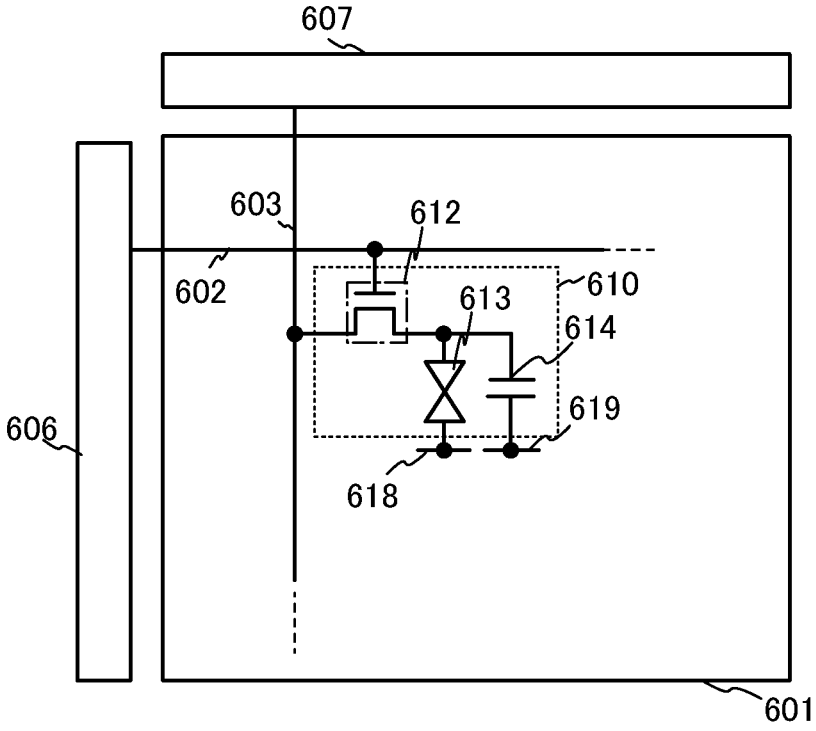
FIG. 4 is a circuit diagram of one embodiment of the present invention.

Next, a structure of the pixel of the display panel 104 is described. Operations of the backlight control circuit 321 of the backlight portion 103 and the driver circuit 312 of the display panel 104 are described with reference to timing charts. First, FIG. 4 is a schematic view of the display panel 104. A display panel in FIG. 4 includes a pixel portion 601, a scan line 602 (also referred to as a gate line), a signal line 603 (also referred to as a data line), a pixel 610, a common electrode 618 (also referred to as a common electrode), a capacitor line 619, a scan line driver circuit 606 which is a driver circuit, and a signal line driver circuit 607 which is a driver circuit.

The pixel 610 includes a pixel transistor 612, a liquid crystal element 613, and a capacitor 614. A gate of the pixel transistor 612 is connected to the scan line 602, a first terminal serving as one of a source and a drain of the pixel transistor 612 is connected to the signal line 603, and a second terminal serving as the other of the source and the drain of the pixel transistor 612 is connected to one electrode of the liquid crystal element 613 and a first electrode of the capacitor 614. The other electrode of the liquid crystal element 613 is connected to the common electrode 618. A second electrode of the capacitor 614 is connected to the capacitor line 619. The pixel transistor 612 is preferably formed using thin film transistors (TFTs) having a thin oxide semiconductor layer.

Note that a thin film transistor is an element having at least three terminals of gate, drain, and source. The thin film transistor includes a channel region between a drain region and a source region, and current can flow through the drain region, the channel region, and the source region. Here, since the source and the drain of the transistor may change depending on the structure, the operating condition, and the like of the transistor, it is difficult to define which is a source or a drain. Therefore, in this document (the specification, the claims, the drawings, and the like), a region functioning as a source and a drain is not called the source or the drain in some cases. In such a case, for example, one of the source and the drain may be referred to as a first terminal and the other thereof may be referred to as a second terminal. Alternatively, one of the source and the drain may be referred to as a first electrode and the other thereof may be referred to as a second electrode. Further alternatively, one of the source and the drain may be referred to as a source region and the other thereof may be called a drain region.

When an oxide semiconductor is used for a semiconductor layer of the pixel transistor 612, off-state current of the transistor can be reduced. Accordingly, an electrical signal such as an image signal can be held for a longer period in the pixel, and a writing interval can be set longer. Therefore, the cycle of one frame period can be set longer, and the frequency of refresh operations in the second period 122 in which the still-image mode is driven can be reduced, whereby an effect of suppressing power consumption can be further increased. In a transistor including an oxide semiconductor, high field-effect mobility can be obtained compared to a transistor including amorphous silicon, whereby writing time can be shortened and high-speed operation is possible.

Note that the scan line driver circuit 606 and the signal line driver circuit 607 are preferably provided over the substrate over which the pixel portion 601 is formed; however, these are not necessarily formed over the substrate over which the pixel portion 601 is formed. When the scan line driver circuit 606 and the signal line driver circuit 607 are provided over the substrate over which the pixel portion 601 is formed, the number of the connection terminals for connection to the outside and the size of the liquid crystal display device can be reduced.

The pixels 610 are arranged (placed) in matrix. Here, description that pixels are provided (arranged) in matrix includes the case where the pixels are arranged in a straight line and the case where the pixels are arranged in a jagged line, in a longitudinal direction or a lateral direction.

Note that when it is explicitly described that "A and B are connected," the case where A and B are electrically connected, the case where A and B are functionally connected, and the case where A and B are directly connected are included therein.

Figure 5A:
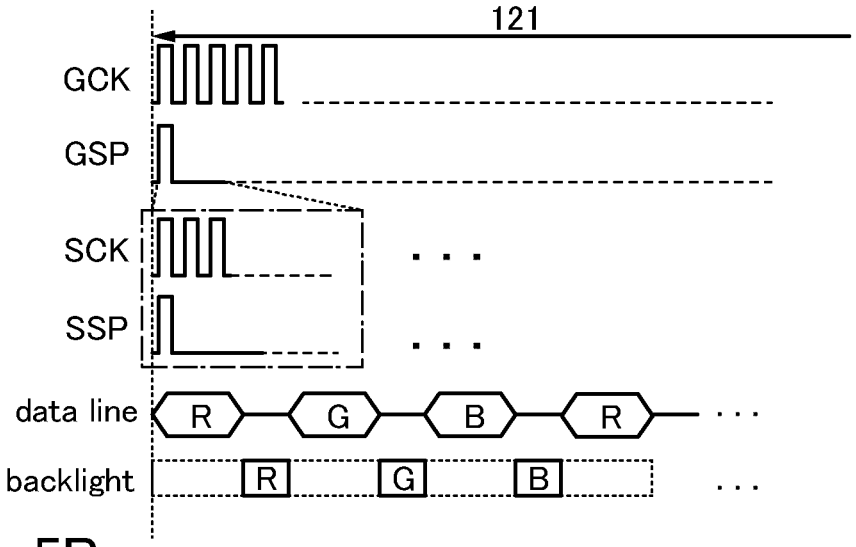
FIGS. 5A and 5B are timing charts of one embodiment of the present invention.
Figure 5B:
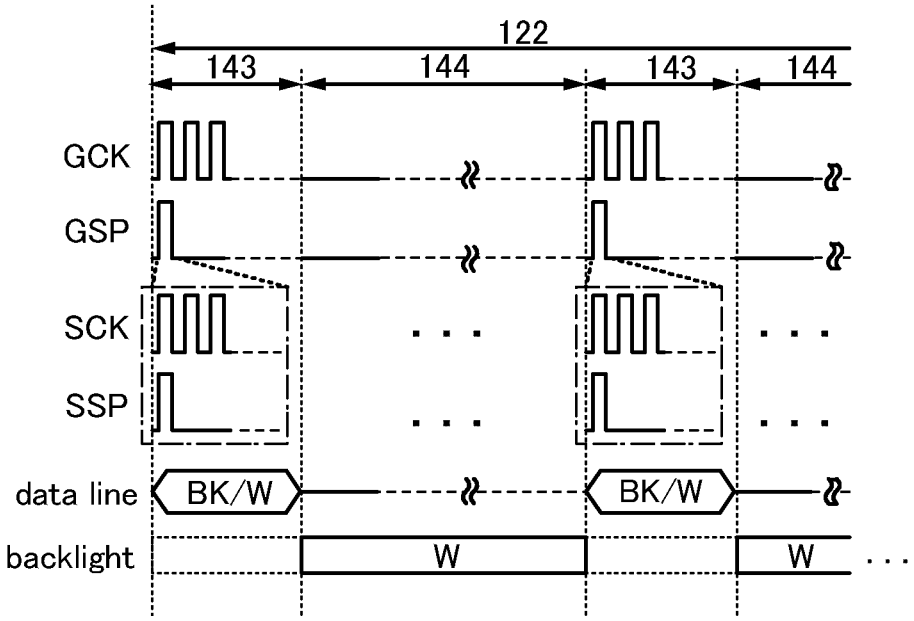

Next, the operations of the backlight 322 of the backlight portion 103 and the driver circuit 312 of the display panel 104 are described with reference to a timing chart. As described above, the operation of the liquid crystal display device of this embodiment is roughly divided into the operation of the moving-image mode in the first period 121 and the operation of the still-image mode in the second period 122. FIG. 5A and FIG. 5B illustrate timing charts of the first period 121 and the second period 122, respectively. The timing charts of FIG. 5A and FIG. 5B are exaggerated for description.

FIG. 5A illustrates a clock signal GCK which is supplied to the scan line driver circuit 106, a start pulses GSP which is supplied to the scan line driver circuit, a clock signal SCK which is supplied to the signal line driver circuit, a start pulse SSP which is supplied to the signal line driver circuit, image signal data, and a lighting state of the backlight in the first period 121. As the backlight, a structure in which three colors of R, G, and B are sequentially lit will be described as an example of the first light source.

In the first period 121, the clock signal GCK becomes a clock signal which is always supplied. The start pulse GSP becomes a pulse corresponding to vertical synchronization frequency. The clock signal SCK becomes a clock signal which is always supplied. The start pulse SSP becomes a pulse corresponding to one gate selection period. A moving image is displayed in the first period 121 with the use of the field sequential system. Therefore, a viewer can see color display of a moving image through repetition of the following operations. An image signal for displaying R (red) is written to each pixel, the backlight of R is lit, then an image signal for displaying G (green) is written to each pixel, the backlight of G is lit, then an image signal for displaying B (blue) is written to each pixel, and the backlight of B is lit.

Next, a still image writing period 143 and a still image holding period 144 in the second period 122 are described with reference to FIG. 5B. In FIG. 5B, the second period 122 is divided into the still image writing periods 143 and the still image holding periods 144 for the description.

In the still image writing period 143, the clock signal GCK serves as a clock signal for writing to one screen. The start pulse GSP serves as a pulse for writing to one screen. The clock signal SCK serves as a clock signal for writing to one screen. The start pulse SSP serves as a pulse for writing to one screen. Note that here, the second light source corresponding to white (W) is turned off in the still image writing period 143 in which an image signal (BK/W) for expressing a monochrome grayscale is written; however, the second light source may be turned on in the still image writing period 143.

In the still image holding period 144, supply of the clock signals GCK, the start pulse GSP, the clock signal SCK, and the start pulse SSP is stopped in order to step the operation of the signal line driver circuit and the scan line driver circuit. Therefore, in the still image holding period 144, power consumption can be reduced and lower power consumption can be achieved. In the still image holding period 144, the image signal written to the pixel in the still image writing period 143 is held by the pixel transistor with extremely low off-state current; therefore, a still image in a grayscale of black and white can be held for longer than or equal to one minute. Note that in this period, the backlight emitted by the second light source corresponding to white (W) is turned on. Before the potential of the held image signal is decreased as a certain period passes, another still image writing period 143 is provided, and an image signal which is the same as the image signal of the previous period is written (refresh operation), and the still image holding period 144 may be provided again.

In the liquid crystal display device described in this embodiment, power consumption can be decreased by reduction in the number of times of writing image signals in displaying a still image. In addition, the second light source corresponding to white as a backlight for displaying a still image is used, and the number of light sources turned on can be reduced in comparison with using white light obtained by turning on light sources of RGB, i.e., the first light source, at the same time; accordingly, power consumption can be reduced.

Then, described with reference to a drawing is an advantage obtained by reduction in the number of times of writing an image signal in the still image holding period 144 illustrated in FIG. 5B. For comparison, first, a schematic view of a liquid crystal display module having a backlight portion and a display panel in the case where an image signal is written in the first period 121 is illustrated in FIG. 6A; and, next, a schematic view of the liquid crystal display module in the case where an image signal is written in the still image holding period 144.

Figure 6A:
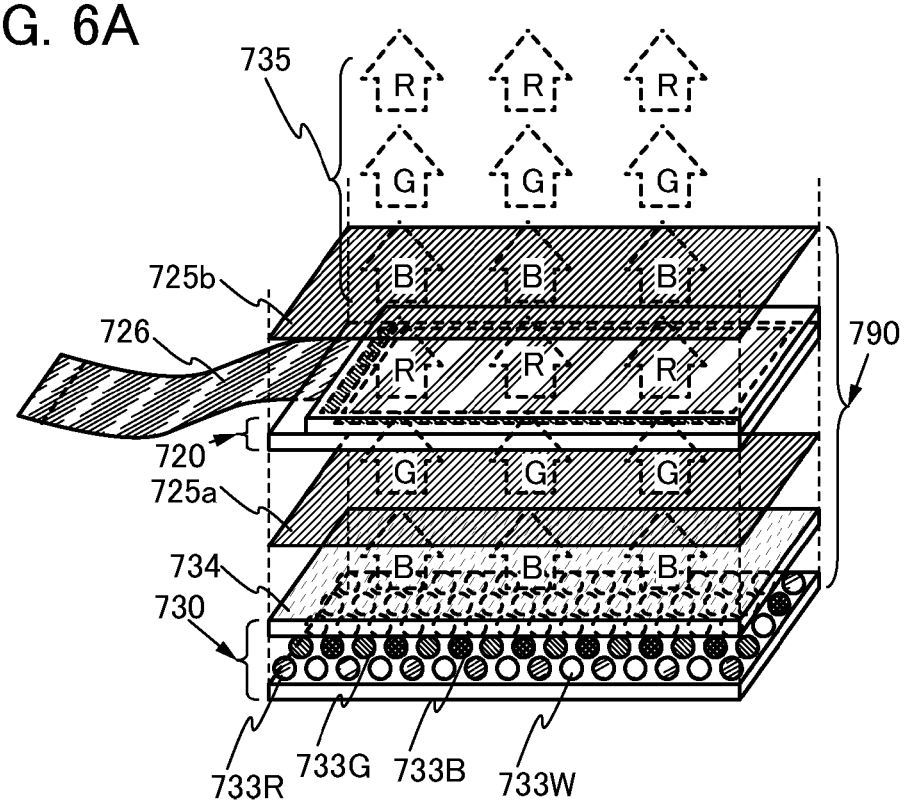
FIGS. 6A and 6B are external views illustrating one embodiment of the present invention.
Figure 6B:
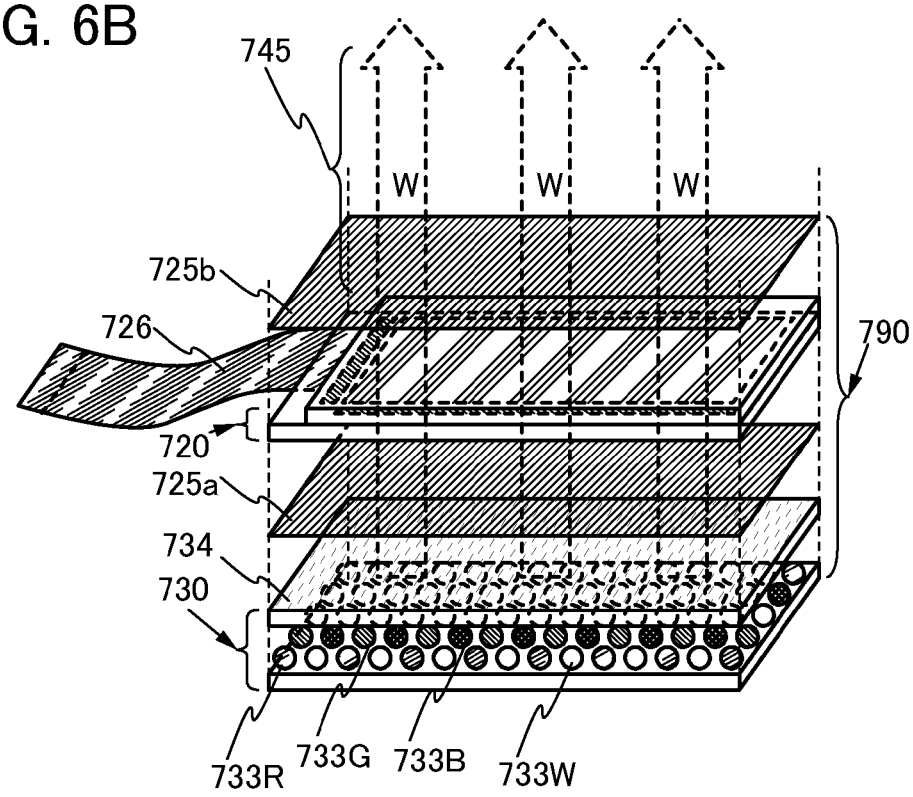

The liquid crystal display module 790 in FIGS. 6A and 6B includes the backlight portion 730, a display panel 720 in which liquid crystal elements are arranged in matrix, and a polarizing plate 725*a* and a polarizing plate 725*b* which are provided with the display panel 720 positioned therebetween. A backlight portion 730 includes light sources which are specifically the first light source including LEDs of RGB (733R, 733G, and 733B) and the second light source of a white LED (733W) provided in matrix, and a diffusing plate 734 provided between the display panel 720 and the light sources. In addition, a flexible printed circuit (FPC) 726 serving as an external input terminal is electrically connected to a terminal portion provided in the display panel 720.

In FIG. 6A, light 735 with three colors are schematically denoted by arrows (R, G, and B). A schematic diagram of FIG. 6A shows the state in which pulse light with different colors sequentially emitted from the backlight portion 730 passes the liquid crystal elements of the display panel 720, and the light is perceived from the observer side.

On the other hand, in FIG. 6B, white light is schematically denoted by arrows (W). A schematic diagram of FIG. 6B shows the state in which white light continuously emitted for a certain period from the backlight portion 730 passes the liquid crystal elements of the display panel 720, and the light can be perceived from the observer side.

That is, in the second period 122, the light source is not turned on/off not as frequently as in the structure in FIG. 6A. In addition, eyestrain may become a problem with a structure such as that in FIG. 6A in which an image signal is frequently written and the light source of the backlight is turned on in accordance with the writing of the image signal. In the case where an image signal is not necessarily rewritten, in the case of displaying a still image in particular, flickers of display due to an image signal can be reduced with a structure in which the number of times of writing an image signal is reduced and a backlight is continuously on. Specifically, in the case of displaying a monochrome still image, eyestrain can be less severe by reducing the number of times of rewriting an image signal and continuously lighting a backlight.

This embodiment can be implemented in appropriate combination with any structure described in the other embodiments.

Embodiment 2

In this embodiment, an example of a plan view and a cross sectional view of a pixel of a display panel is described with reference to drawings.

Figure 7A:
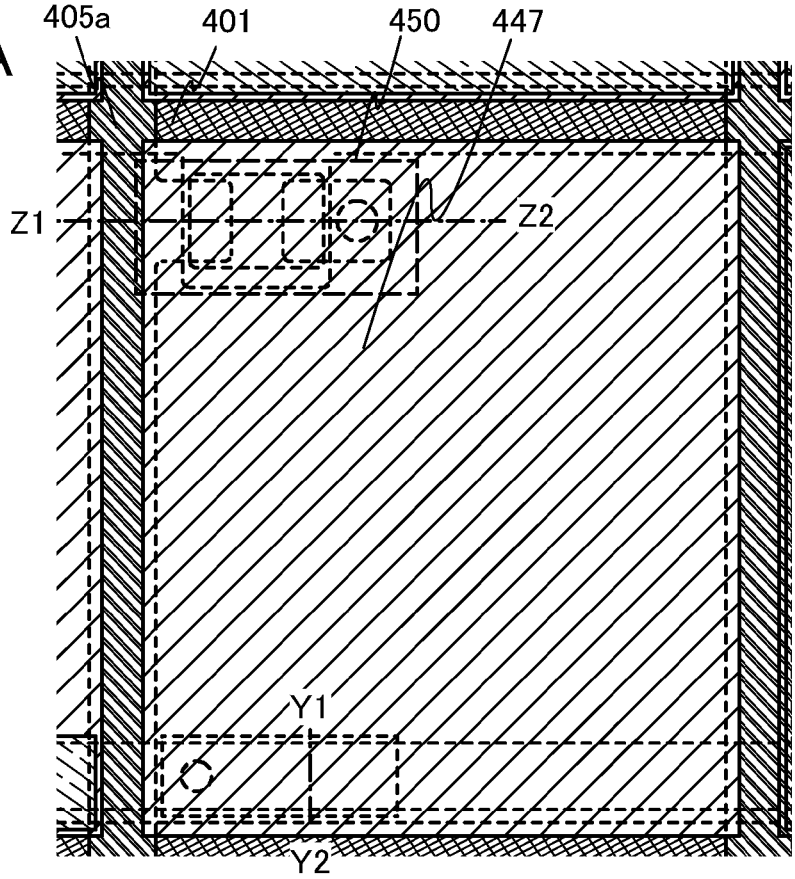
FIG. 7A is a top view and FIG. 7B is a cross sectional view illustrating one embodiment of the present invention.
Figure 7B:
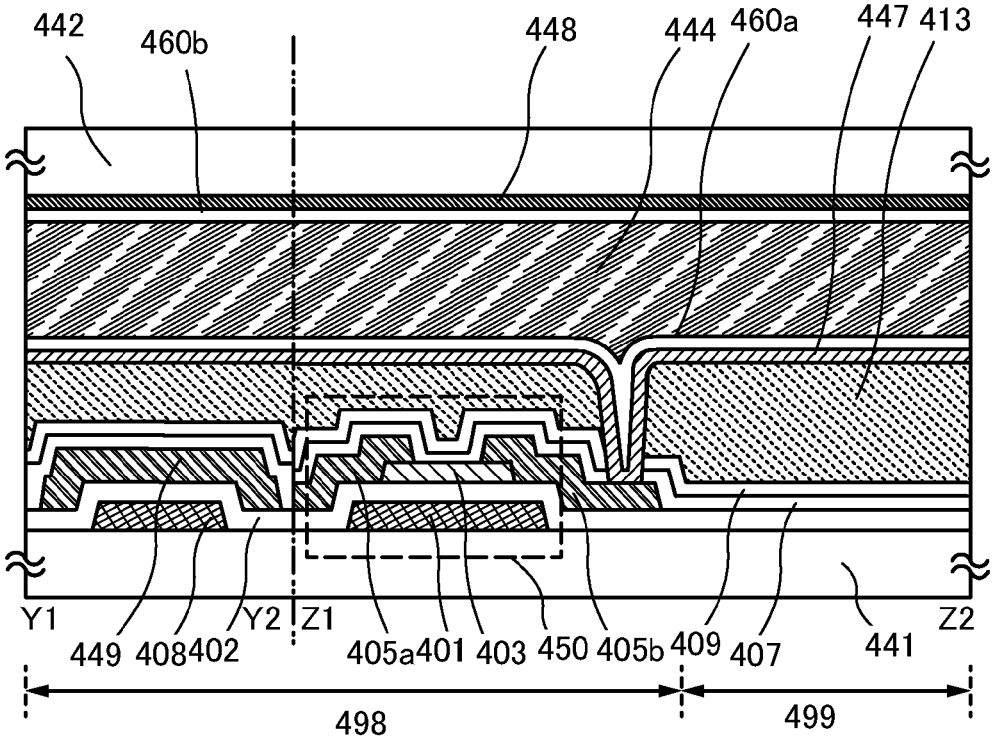

FIG. 7A is a plan view illustrating one pixel of the display panel. FIG. 7B is a cross-sectional view taken along lines Y1-Y2 and Z1-Z2 of FIG. 7A.

In FIG. 7A, a plurality of source wiring layers (including a source electrode layer 405*a* or a drain electrode layer 405*b*) are arranged in parallel (extends in the vertical direction in the drawing) to be spaced from each other. A plurality of gate wiring layers (including the gate electrode layer 401) are provided apart from each other and extended in a direction generally perpendicular to the source wiring layers (a horizontal direction in the drawing). Capacitor wiring layers 408 are arranged adjacent to the plurality of gate wiring layers and extend in a direction generally parallel to the gate wiring layers, that is, in a direction generally perpendicular to the source wiring layers (in the horizontal direction in the drawing).

In a liquid crystal display device in FIGS. 7A and 7B, a transparent electrode layer 447 is formed as a pixel electrode layer. An insulating film 407 and a protective insulating layer 409 and the interlayer film 413 are provided over a transistor 450. The transparent electrode layer 447 are electrically connected to the transistor 450 through an opening (contact hole) provided in the insulating film 407 and the protective insulating layer 409 and the interlayer film 413.

As illustrated in FIG. 7B, a common electrode layer 448 (also referred to as a counter electrode layer) is formed on a second substrate 442 and faces the transparent electrode layer 447 over a first substrate 441 with a liquid crystal layer 444 provided therebetween. Note that in FIGS. 7A and 7B, an alignment film 460*a* is provided between the transparent electrode layer 447 and the liquid crystal layer 444, an alignment film 460*b* is provided between the common electrode layer 448 and the liquid crystal layer 444. The alignment films 460*a* and 460*b* are insulating layers having a function of controlling alignment of liquid crystal and therefore, are not necessarily provided depending on a material of the liquid crystal.

The transistor 450 is an example of a bottom-gate inverted-staggered transistor and includes a gate electrode layer 401, a gate insulating layer 402, an oxide semiconductor layer 403, the source electrode layer 405*a*, and the drain electrode layer 405*b*. In addition, the capacitor wiring layer 408 which is formed in the same step as the gate electrode layer 401, the gate insulating layer 402, and the conductive layer 449 which is formed in the same step as the source electrode layer 405*a* or the drain electrode layer 405*b* are stacked to form a capacitor.

This embodiment can be implemented in appropriate combination with the structures described in the other embodiments.

Embodiment 3

In this embodiment, an example of a structure of a backlight portion (also referred to as a backlight or a backlight unit) which can be used for the liquid crystal display device disclosed in this specification will be described with reference to FIGS. 8A to 8C.

Figure 8A:
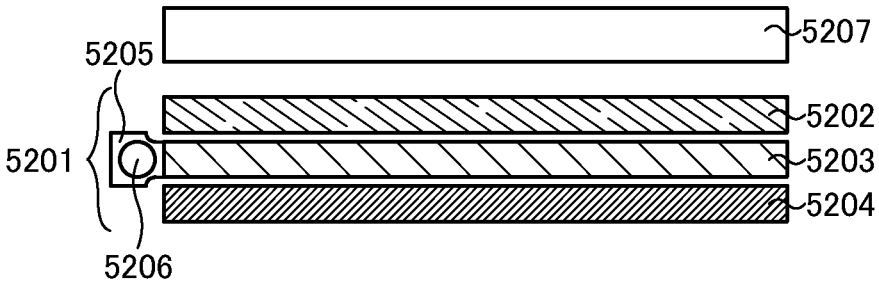
FIGS. 8A to 8C illustrate one embodiment of the present invention.

FIG. 8A illustrates an example of a liquid crystal display device including a backlight portion 5201 which is called edge-light type and a display panel 5207. An edge-light type has a structure in which a light source is provided at an end of the backlight portion and light from the light source is emitted from the entire light-emitting surface.

The backlight portion 5201 includes a diffusion plate 5202 (also referred to as a diffusion sheet), a light guide plate 5203, a reflection plate 5204, a lamp reflector 5205, and a light source 5206. Note that the backlight portion 5201 may also include a luminance improvement film or the like.

The light source 5206 has a function of emitting light with different colors (RGB) as necessary. For example, as the light source 5206, a cold cathode fluorescent lamp (CCFL) provided with a color filter, a light emitting diode, an EL element, or the like is used.

Figure 8B:
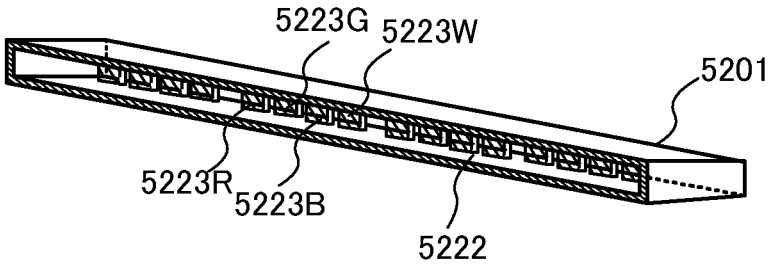

FIG. 8B illustrates a detailed structure of an edge-light type backlight portion. Note that description of the diffusion plate, the light guide plate, the reflection plate, and the like is omitted.

The backlight portion 5201 illustrated in FIG. 8B has a structure in which light-emitting diodes (LEDs) 5223R, 5223G, 5223B, and 5223W corresponding to R, G, B, and W, respectively are used as light sources. The light-emitting diodes (LEDs) 5223R, 5223G, 5223B, and 5223W corresponding to R, G, B and W, respectively are provided at a predetermined interval. In addition, a lamp reflector 5222 is provided to efficiently reflect light from the light-emitting diodes (LEDs) 5223R, 5223G, 5223B, and 5223W corresponding to R, G, B, and W, respectively.

Figure 8C:
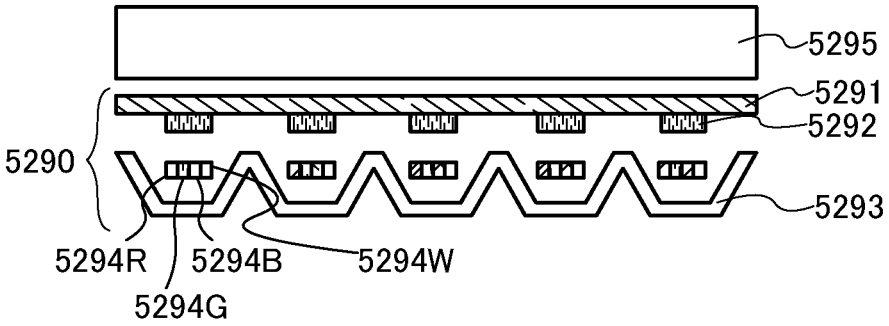

FIG. 8C illustrates an example of a liquid crystal display device including a backlight portion which is called direct-below-type and a liquid crystal panel. A direct-below type has a structure in which a light source is provided directly under a light-emitting surface and light from the light source is emitted from the entire light-emitting surface.

A backlight portion 5290 includes a diffusion plate 5291, a light-shielding portion 5292, a lamp reflector 5293, and light-emitting diodes (LEDs) 5294R, 5294G, 5294B and 5295W corresponding to R, G, B and W, respectively, which are overlapped with the liquid crystal panel 5295.

Note that in the what is called direct-below-type backlight portion, an EL element which is a light-emitting element is used instead of a light-emitting diode (LED) serving as a light source, so that the thickness of the backlight portion can be reduced.

Note that the backlight portion described in FIGS. 8A to 8C may have a structure in which luminance is adjusted. For example, luminance is adjusted in accordance with illuminance around the liquid crystal display device or luminance is adjusted in accordance with an image signal for display may be employed.

This embodiment can be combined with any of structures described in the other embodiments as appropriate.

Embodiment 4

In this embodiment, an example of a transistor that can be applied to a liquid crystal display device disclosed in this specification will be described. There is no particular limitation on a structure of the transistor that can be applied to the liquid crystal display device disclosed in this specification. For example, a staggered transistor, a planar transistor, or the like having a top-gate structure in which a gate electrode is provided above an oxide semiconductor layer with a gate insulating layer interposed or a bottom-gate structure in which a gate electrode is provided below an oxide semiconductor layer with a gate insulating layer interposed, can be used. The transistor may have a single gate structure including one channel formation region, a double gate structure including two channel formation regions, or a triple gate structure including three channel formation regions. Alternatively, the transistor may have a dual gate structure including two gate electrode layers provided over and below a channel region with a gate insulating layer interposed. FIGS. 9A to 9D illustrate examples of cross-sectional structures of transistors. Each of the transistors illustrated in FIGS. 9A to 9D includes an oxide semiconductor as a semiconductor layer. An advantage of using an oxide semiconductor is that high field-effect mobility (the maximum value is 5 $cm^2$/Vsec or higher, preferably in the range of 10 $cm^2$/Vsec to 150 $cm^2$/Vsec) can be obtained when a transistor is on, and low off-state current (for example, off-state current per channel width is lower than 1 aA/μm, preferably lower than 10 zA/μm at room temperature and lower than 100 zA/μm at 85° C.) can be obtained when the transistor is off.

Figure 9A:
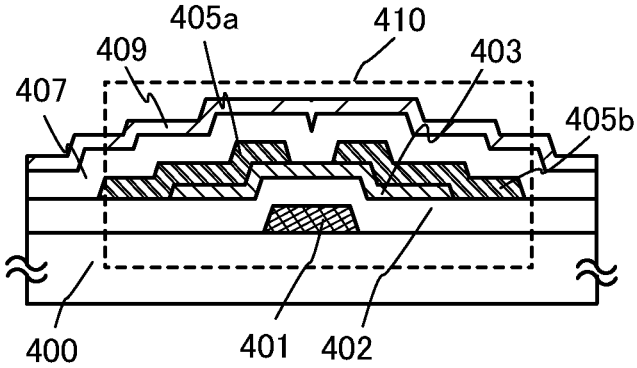
FIGS. 9A to 9D each illustrate one embodiment of the present invention.

A transistor 410 illustrated in FIG. 9A is one of bottom-gate transistors and is also referred to as an inverted staggered transistor.

The transistor 410 includes, over a substrate 400 having an insulating surface, a gate electrode layer 401, a gate insulating layer 402, an oxide semiconductor layer 403, a source electrode layer 405*a*, and a drain electrode layer 405*b*. An insulating film 407 is provided to cover the transistor 410 and be stacked over the oxide semiconductor layer 403. Further, a protective insulating layer 409 is formed over the insulating film 407.

Figure 9B:
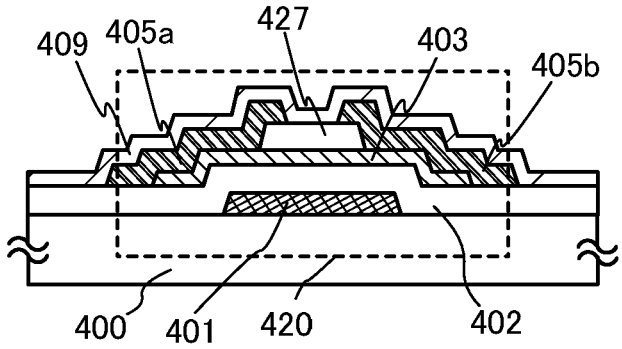

A transistor 420 illustrated in FIG. 9B is one of bottom-gate transistors referred to as a channel-protective type (also referred to as a channel-stop type) and is also referred to as an inverted staggered transistor.

The transistor 420 includes, over the substrate 400 having an insulating surface, the gate electrode layer 401, the gate insulating layer 402, the oxide semiconductor layer 403, an insulating layer 427 functioning as a channel protective layer covering a channel formation region of the oxide semiconductor layer 403, the source electrode layer 405*a*, and the drain electrode layer 405*b*. Further, the protective insulating layer 409 is formed to cover the transistor 420.

Figure 9C:
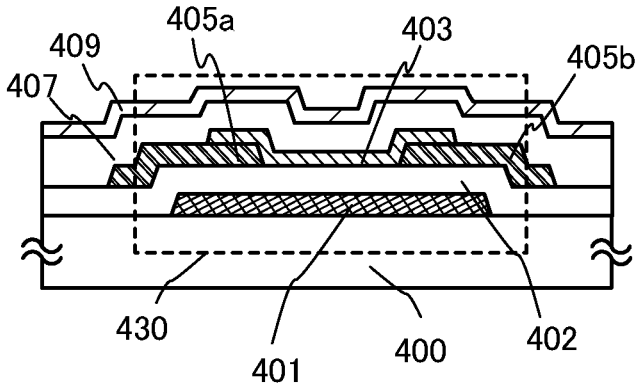

A transistor 430 illustrated in FIG. 9C is a bottom-gate transistor and includes, over the substrate 400 having an insulating surface, the gate electrode layer 401, the gate insulating layer 402, the source electrode layer 405*a*, the drain electrode layer 405*b*, and the oxide semiconductor layer 403. The insulating film 407 is provided to cover the transistor 430 and to be in contact with the oxide semiconductor layer 403. Further, the protective insulating layer 409 is formed over the insulating film 407.

In the transistor 430, the gate insulating layer 402 is provided over and in contact with the substrate 400 and the gate electrode layer 401; the source electrode layer 405*a* and the drain electrode layer 405*b* are provided over and in contact with the gate insulating layer 402. The oxide semiconductor layer 403 is provided over the gate insulating layer 402, the source electrode layer 405*a*, and the drain electrode layer 405*b*.

Figure 9D:
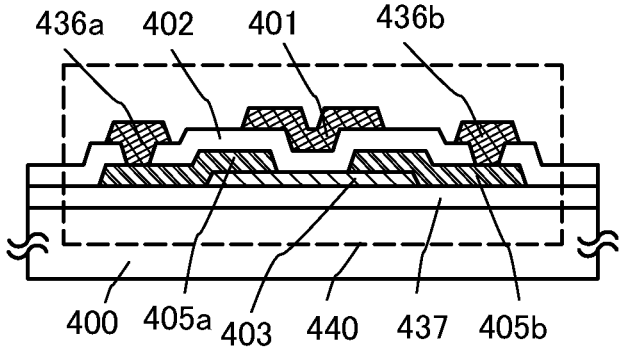

A transistor 440 illustrated in FIG. 9D is one of top-gate transistors. The transistor 440 includes, over the substrate 400 having an insulating surface, an insulating layer 437, the oxide semiconductor layer 403, the source electrode layer 405*a*, the drain electrode layer 405*b*, the gate insulating layer 402, and the gate electrode layer 401. A wiring layer 436*a* and a wiring layer 436*b* are provided in contact with and electrically connected to the source electrode layer 405*a* and the drain electrode layer 405*b* respectively.

In this embodiment, the oxide semiconductor layer 403 is used as a semiconductor layer as described above. As an oxide semiconductor used for the oxide semiconductor layer 403, the following metal oxides can be used: a four-component metal oxide such as an In—Sn—Ga—Zn—O-based oxide semiconductor; a three-component metal oxide such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor; a two-component metal oxide such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor; an In—O—based oxide semiconductor; a Sn—O-based oxide semiconductor; a Zn—O-based oxide semiconductor; an In—Ga—O-based oxide semiconductor. In addition, $SiO_2$ may be contained in the above oxide semiconductor. Here, for example, an In—Ga—Zn—O-based oxide semiconductor means an oxide containing indium (In), gallium (Ga), and zinc (Zn), and there is no particular limitation on the composition ratio thereof. The In—Ga—Zn—O-based oxide semiconductor may contain an element other than In, Ga, and Zn.

As the oxide semiconductor layer 403, a thin film represented by a chemical formula of $InMO_3(ZnO)_m$ (m>0) can be used. Here, M represents one or more metal elements selected from Zn, Ga, Al, Mn, and Co. For example, M can be Ga, Ga and Al, Ga and Mn, Ga and Co, or the like.

In each of the transistors 410, 420, 430, and 440 including the oxide semiconductor layer 403, the current value in an off state (off-state current value) can be reduced. Thus, in a pixel, a capacitor for holding an electric signal such as an image signal can be designed to be smaller. Accordingly, the aperture ratio of the pixel can be increased, so that power consumption can be suppressed.

In addition, each of the transistors 410, 420, 430, and 440 including the oxide semiconductor layer 403 has low off-state current. Accordingly, an electrical signal such as an image signal can be held for a longer period in the pixel, and a writing interval can be set longer. Therefore, the cycle of one frame period can be set longer, and the frequency of refresh operations in a still image display period can be reduced, whereby an effect of suppressing power consumption can be further increased. In addition, since a driver circuit portion and a pixel portion each including the above transistors can be formed over one substrate, the number of components of the liquid crystal display device can be reduced.

There is no limitation on a substrate that can be applied to the substrate 400 having an insulating surface; however, a glass substrate such as a glass substrate made of barium borosilicate glass or aluminosilicate glass is used.

In the bottom-gate transistors 410, 420, and 430, an insulating film serving as a base film may be provided between the substrate and the gate electrode layer. The base film has a function of preventing diffusion of an impurity element from the substrate, and can be formed to have a stacked-layer structure using one or more of a silicon nitride film, a silicon oxide film, a silicon nitride oxide film, and a silicon oxynitride film.

The gate electrode layer 401 can be formed to have a single-layer structure or a stacked-layer structure using any of a metal material such as molybdenum, titanium, chromium, tantalum, tungsten, aluminum, copper, neodymium, or scandium, or an alloy material which contains any of these materials as its main component.

The gate insulating layer 402 can be formed with a single-layer structure or a stacked structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma CVD method, a sputtering method, or the like. For example, a silicon nitride layer ($SiN_y$ (y>0)) having a thickness of 50 nm to 200 nm inclusive is formed as a first gate insulating layer by a plasma CVD method, and a silicon oxide layer ($SiO_x$ (x>0)) having a thickness of 5 nm to 300 nm inclusive is formed as a second gate insulating layer over the first gate insulating layer, so that a gate insulating layer with a total thickness of 200 nm is formed.

As a conductive film used for the source electrode layer 405*a* and the drain electrode layer 405*b*, for example, a metal film containing an element selected from Al, Cr, Cu, Ta, Ti, Mo, and W and a metal nitride film containing the above elements as its main component (a titanium nitride film, a molybdenum nitride film, and a tungsten nitride film) can be used. A metal film having a high melting point of Ti, Mo, W, or the like or a metal nitride film of these elements (a titanium nitride film, a molybdenum nitride film, and a tungsten nitride film) may be stacked on one of or both of a lower side or an upper side of a metal film of Al, Cu, or the like.

A conductive film functioning as the wiring layer 436*a* and the wiring layer 436*b* connected to the source electrode layer 405*a* and the drain electrode layer 405*b* can be formed using a material similar to that of the source electrode layer 405*a* and the drain electrode layer 405*b*.

The conductive film to be the source electrode layer 405*a* and the drain electrode layer 405*b* (including a wiring layer formed using the same layer as the source electrode layer 405*a* and the drain electrode layer 405*b*) may be formed using conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), and such a metal oxide material containing silicon oxide can be used.

As the insulating films 407 and the insulating layer 427 provided over the oxide semiconductor layer, and the insulating layer 437 provided under the oxide semiconductor layer, an inorganic insulating film such as a silicon oxide film, a silicon oxynitride film, an aluminum oxide film, an aluminum oxynitride film, or the like can be typically used.

For the protective insulating layer 409 provided over the oxide semiconductor layer, an inorganic insulating film such as a silicon nitride film, an aluminum nitride film, a silicon nitride oxide film, or an aluminum nitride oxide film can be used.

Further, a planarization insulating film may be formed over the protective insulating layer 409 so that surface roughness due to the transistor is reduced. As the planarization insulating film, an organic material such as polyimide, acrylic, and benzocyclobutene can be used. Besides the above organic materials, a low-dielectric constant material (a low-k material) or the like can be used. Note that the planarization insulating film may be formed by stacking a plurality of insulating films formed of these materials.

As described above, a transistor in this embodiment including a highly-purified oxide semiconductor layer has low off-state current. Accordingly, an electrical signal such as an image signal can be held for a longer period in the pixel, and a writing interval can be set longer. Therefore, the cycle of one frame period can be set longer, and the frequency of refresh operations in a still image display period can be reduced, whereby an effect of suppressing power consumption can be further increased. In addition, a highly-purified oxide semiconductor layer is preferably used because such a layer can be manufactured without a process such as laser irradiation and can realize formation of a transistor over a large substrate.

This embodiment can be implemented in appropriate combination with the structure described in any of other embodiments.

Embodiment 5

In this embodiment, examples of a transistor including an oxide semiconductor layer and a manufacturing method thereof will be described in detail below with reference to FIGS. 10A to 10E. The same portion as or a portion having a function similar to those in the above embodiments, and repetitive description is omitted. In addition, detailed description of the same portions is not repeated.

FIGS. 10A to 10E illustrate an example of a cross-sectional structure of a transistor. A transistor 510 illustrated in FIGS.

10A to 10E is an inverted staggered thin film transistor having a bottom gate structure, which is similar to the transistor 410 illustrated in FIG. 9A.

Hereinafter, a manufacturing process of the transistor 510 over a substrate 505 is described with reference to FIGS. 10A to 10E.

First, a conductive film is formed over the substrate 505 having an insulating surface, and then, a gate electrode layer 511 is formed through a first photolithography step. Note that a resist mask may be formed by an inkjet method. Formation of the resist mask by an inkjet method needs no photomask; thus, manufacturing cost can be reduced.

As the substrate 505 having an insulating surface, a substrate similar to the substrate 400 described in Embodiment 4 can be used. In this embodiment, a glass substrate is used as the substrate 505.

An insulating film serving as a base film may be provided between the substrate 505 and the gate electrode layer 511. The base film has a function of preventing diffusion of an impurity element from the substrate 505, and can be formed with a single-layer structure or a stacked-layer structure using one or more of a silicon nitride film, a silicon oxide film, a silicon nitride oxide film, and a silicon oxynitride film.

The gate electrode layer 511 can be formed to have a single-layer structure or a stacked-layer structure using any of a metal material such as molybdenum, titanium, tantalum, tungsten, aluminum, copper, neodymium, or scandium, and an alloy material which includes any of these as a main component.

Next, a gate insulating layer 507 is formed over the gate electrode layer 511. The gate insulating layer 507 can be formed by a plasma CVD method, a sputtering method, or the like to have a single layer structure or a stacked-layer structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer.

For the oxide semiconductor in this embodiment, an oxide semiconductor which is made to be an i-type semiconductor or a substantially i-type semiconductor by removing an impurity is used. Such a highly purified oxide semiconductor is highly sensitive to an interface state and interface charges; thus, an interface between the oxide semiconductor layer and the gate insulating layer is important. For that reason, the gate insulating layer that is to be in contact with a highly purified oxide semiconductor needs to have high quality.

For example, high-density plasma CVD using microwaves (e.g., with a frequency of 2.45 GHz) is preferably adopted because an insulating layer can be dense and have high withstand voltage and high quality. The highly purified oxide semiconductor and the high-quality gate insulating layer are in close contact with each other, whereby the interface state density can be reduced to obtain favorable interface characteristics.

Needless to say, another film formation method such as a sputtering method or a plasma CVD method can be employed as long as the method enables formation of a high-quality insulating layer as a gate insulating layer. Further, an insulating layer whose film quality and characteristics of the interface between the insulating layer and an oxide semiconductor are improved by heat treatment which is performed after formation of the insulating layer may be formed as a gate insulating layer. In any case, any insulating layer may be used as long as the insulating layer has characteristics of enabling a reduction in interface state density of the interface between the insulating layer and an oxide semiconductor and formation of a favorable interface as well as having favorable film quality as a gate insulating layer.

In order to contain hydrogen, a hydroxyl group, and moisture in the gate insulating layer 507 and an oxide semiconductor film 530 as little as possible, it is preferable to perform pretreatment for formation of the oxide semiconductor film 530. As the pretreatment, the substrate 505 provided with the gate electrode layer 511 or a substrate 505 over which the gate electrode layer 511 and the gate insulating layer 507 are formed is preheated in a preheating chamber of a sputtering apparatus, whereby an impurity such as hydrogen or moisture adsorbed on the substrate 505 is removed and then, evacuation is performed. As an evacuation unit provided in the preheating chamber, a cryopump is preferable. Note that this preheating treatment can be omitted. Further, the above preheating may be performed in a similar manner, on the substrate 505 in a state where a source electrode layer 510A and a drain electrode layer 510B have been formed thereover but an insulating layer 516 has not been formed yet.

Figure 10A:
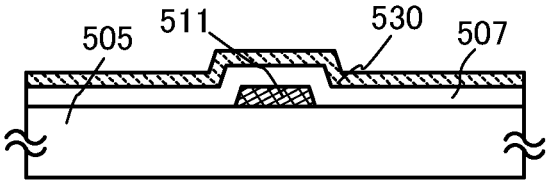
FIGS. 10A to 10E each illustrate one embodiment of the present invention.
Figure 10B:
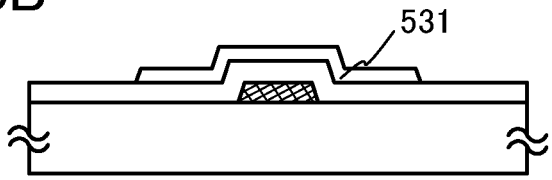
Figure 10C:
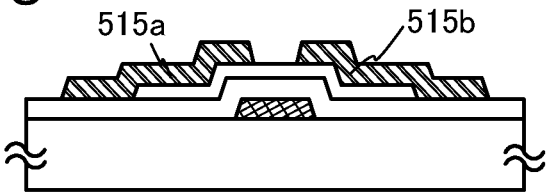

Next, over the gate insulating layer 507, the oxide semiconductor film 530 having a thickness greater than or equal to 2 nm and less than or equal to 200 nm, preferably greater than or equal to 5 nm and less than or equal to 30 nm is formed (see FIG. 10A).

Note that before the oxide semiconductor film 530 is formed by a sputtering method, powder substances (also referred to as particles or dust) which attach on a surface of the gate insulating layer 507 are preferably removed by reverse sputtering in which an argon gas is introduced and plasma is generated. The reverse sputtering refers to a method in which, without applying a voltage to a target side, an RF power source is used for application of a voltage to a substrate side in an argon atmosphere to generate plasma in the vicinity of the substrate to modify a surface. Note that instead of an argon atmosphere, a nitrogen atmosphere, a helium atmosphere, an oxygen atmosphere, or the like may be used.

As an oxide semiconductor for the oxide semiconductor film 530, the oxide semiconductor described in Embodiment 3 can be used. Further, $SiO_2$ may be contained in the above oxide semiconductor. In this embodiment, the oxide semiconductor film 530 is deposited by a sputtering method with the use of an In—Ga—Zn—O-based oxide target. A cross-sectional view at this stage is illustrated in FIG. 10A. Alternatively, the oxide semiconductor film 530 can be formed by a sputtering method in a rare gas (typically argon) atmosphere, an oxygen atmosphere, or a mixed atmosphere containing a rare gas (typically argon) and oxygen.

The target used for formation of the oxide semiconductor film 530 by a sputtering method is, for example, an oxide target containing $In_2O_3$, $Ga_2O_3$, and ZnO at a composition ratio of 1:1:1 [molar ratio], so that an In—Ga—Zn—O film is formed. Without limitation to the material and the component of the target, for example, an oxide target containing $In_2O_3$, $Ga_2O_3$, and ZnO at 1:1:2 [molar ratio] may be used.

The filling factor of the oxide target is greater than or equal to 90% and less than or equal to 100%, preferably greater than or equal to 95% and less than or equal to 99.9%. With use of the oxide target with high filling factor, a dense oxide semiconductor film can be formed.

It is preferable that a high-purity gas from which an impurity such as hydrogen, water, a hydroxyl group, or a hydride has been removed be used as a sputtering gas used for forming the oxide semiconductor film 530.

The substrate is held in a deposition chamber kept under reduced pressure, and the substrate temperature is set to 100° C. to 600° C. inclusive, preferably 200° C. to 400° C. inclusive. Formation of the oxide semiconductor film is conducted with heating the substrate, whereby the concentration of impurities included in the formed oxide semiconductor film can be reduced. In addition, damage by sputtering can be reduced. Then, a sputtering gas from which hydrogen and moisture are removed is introduced into the deposition chamber where remaining moisture is being removed, and the oxide semiconductor film 530 is deposited with use of the above target, over the substrate 505. In order to remove remaining moisture from the deposition chamber, an adsorption-type vacuum pump such as a cryopump, an ion pump, or a titanium sublimation pump is preferably used. The evacuation unit may be a turbo pump provided with a cold trap. In the deposition chamber which is evacuated with use of the cryopump, a hydrogen atom, a compound including a hydrogen atom, such as water ($H_2O$), (more preferably, also a compound including a carbon atom), and the like are removed, whereby the concentration of impurities in the oxide semiconductor film formed in the deposition chamber can be reduced.

As one example of the deposition condition, the distance between the substrate and the target is 100 mm, the pressure is 0.6 Pa, the direct-current (DC) power source is 0.5 kW, and the atmosphere is an oxygen atmosphere (the proportion of the oxygen flow rate is 100%). Note that use of a pulse direct current power source is preferable because powder substances (also referred to as particles or dust) generated in film formation can be reduced and the film thickness can be uniform.

Then, through a second photolithography step, the oxide semiconductor film 530 is processed into an island-shaped oxide semiconductor layer. A resist mask for forming the island-shaped oxide semiconductor layer may be formed by an ink-jet method. Formation of the resist mask by an inkjet method needs no photomask; thus, manufacturing cost can be reduced.

In the case where a contact hole is formed in the gate insulating layer 507, a step of forming the contact hole can be performed at the same time as processing of the oxide semiconductor film 530.

Note that the etching of the oxide semiconductor film 530 may be dry etching, wet etching, or both dry etching and wet etching. As an etchant used for wet etching of the oxide semiconductor film 530, for example, a mixed solution of phosphoric acid, acetic acid, and nitric acid, or the like can be used. In addition, ITO07N (produced by KANTO CHEMICAL CO., INC.) may be used.

Next, the oxide semiconductor layer is subjected to first heat treatment. By this first heat treatment, the oxide semiconductor layer can be dehydrated or dehydrogenated. The temperature of the first heat treatment is higher than or equal to 400° C. and lower than or equal to 750° C., preferably higher than or equal to 400° C. and lower than the strain point of the substrate. Here, the substrate is introduced into an electric furnace which is one of heat treatment apparatuses, heat treatment is performed on the oxide semiconductor layer in a nitrogen atmosphere at 450° C. for one hour, and then, the oxide semiconductor layer is not exposed to the air so that entry of water and hydrogen into the oxide semiconductor layer is prevented; thus, an oxide semiconductor layer 531 is obtained (see FIG. 10B).

Further, a heat treatment apparatus used in this step is not limited to an electric furnace, and a device for heating an object to be processed by heat conduction or heat radiation from a heating element such as a resistance heating element may be alternatively used. For example, an RTA (rapid thermal anneal) apparatus such as a GRTA (gas rapid thermal anneal) apparatus or an LRTA (lamp rapid thermal anneal) apparatus can be used. An LRTA apparatus is an apparatus for heating an object to be processed by radiation of light (an electromagnetic wave) emitted from a lamp such as a halogen lamp, a metal halide lamp, a xenon arc lamp, a carbon arc lamp, a high pressure sodium lamp, or a high pressure mercury lamp. A GRTA apparatus is an apparatus for heat treatment using a high-temperature gas. As the high temperature gas, an inert gas which does not react with an object to be processed by heat treatment, such as nitrogen or a rare gas like argon, is used.

For example, as the first heat treatment, GRTA may be performed as follows: the substrate is transferred and put into an inert gas heated to a high temperature as high as 650° C. to 700° C., heated for several minutes, and taken out from the inert gas heated to the high temperature.

Note that in the first heat treatment, it is preferable that water, hydrogen, and the like be not contained in the atmosphere of nitrogen or a rare gas such as helium, neon, or argon. The purity of nitrogen or the rare gas such as helium, neon, or argon which is introduced into the heat treatment apparatus is preferably set to be 6N (99.9999%) or higher, far preferably 7N (99.99999%) or higher (that is, the impurity concentration is preferably 1 ppm or lower, far preferably 0.1 ppm or lower).

After the oxide semiconductor layer is heated by the first heat treatment, a high-purity oxygen gas, a high-purity $N_2O$ gas, or ultra-dry air (having a dew point of −40° C. or lower, preferably −60° C. or lower) may be introduced into the same furnace. It is preferable that water, hydrogen, or the like be not contained in the oxygen gas or the $N_2O$ gas. Alternatively, the purity of an oxygen gas or an $N_2O$ gas which is introduced into the heat treatment apparatus is preferably 6N or more, further preferably 7N or more (i.e., the impurity concentration of the oxygen gas or the $N_2O$ gas is 1 ppm or lower, preferably 0.1 ppm or lower). Although oxygen which is a main component included in the oxide semiconductor has been reduced through the elimination of impurities by performance of dehydration treatment or dehydrogenation treatment, oxygen is supplied by the effect of introduction of the oxygen gas or the $N_2O$ gas in the above manner, so that the oxide semiconductor layer is highly purified and made to be an electrically i-type (intrinsic) semiconductor.

Alternatively, the first heat treatment of the oxide semiconductor layer can be performed on the oxide semiconductor film 530 which has not yet been processed into the island-shaped oxide semiconductor layer. In that case, the substrate is taken out from the heat apparatus after the first heat treatment, and then a photolithography step is performed.

Note that other than the above timing, the first heat treatment may be performed at any of the following timings as long as it is after the oxide semiconductor film is formed. For example, the timing may be after a source electrode layer and a drain electrode layer are formed over the oxide semiconductor layer or after an insulating layer is formed over the source electrode layer and the drain electrode layer.

Further, in the case where a contact hole is formed in the gate insulating layer 507, the formation of the contact hole may be performed before or after the first heat treatment is performed on the oxide semiconductor film 530.

Alternatively, an oxide semiconductor layer may be formed through two deposition steps and two heat treatment steps. The thus formed oxide semiconductor layer has a thick crystalline region (single crystalline region), that is, a crystalline region the c-axis of which is aligned in a direction perpendicular to a surface of the layer, even when a base component includes any of an oxide, a nitride, a metal, or the like. For example, a first oxide semiconductor film with a thickness greater than or equal to 3 nm and less than or equal to 15 nm is deposited, and first heat treatment is performed in a nitrogen, oxygen, rare gas, or dry air atmosphere at 450° C. to 850° C. inclusive, preferably 550° C. to 750° C. inclusive, so that the first oxide semiconductor film has a crystalline region (including a plate-like crystal) in a region including its surface. Then, a second oxide semiconductor film which has a larger thickness than the first oxide semiconductor film is formed, and second heat treatment is performed at 450° C. to 850° C. inclusive or preferably 600° C. to 700° C. inclusive, so that crystal growth proceeds upward with use of the first oxide semiconductor film as a seed of the crystal growth and the whole second oxide semiconductor film is crystallized. In such a manner, the oxide semiconductor layer having a thick crystalline region may be obtained.

Next, a conductive film to be the source and drain electrode layers (including a wiring formed in the same layer as the source and drain electrode layers) is formed over the gate insulating layer 507 and the oxide semiconductor layer 531. The conductive film to be the source and drain electrode layers can be formed using the material which is used for the source electrode layer 405*a* and the drain electrode layer 405*b* described in Embodiment 3.

By performance of a third photolithography step, a resist mask is formed over the conductive film, and selective etching is performed, so that the source electrode layer 510A and the drain electrode layer 510B are formed. Then, the resist mask is removed (see FIG. 10C).

Light exposure at the time of the formation of the resist mask in the third photolithography step may be performed using ultraviolet light, KrF laser light, or ArF laser light. A channel length L of the transistor formed later is determined by the distance between the lower edge portion of the source electrode layer and the lower edge portion of the drain electrode layer which are next to each other over the oxide semiconductor layer 531. In the case where a channel length L is less than 25 nm, light exposure for formation of the resist mask in the third photolithography step may be performed using extreme ultraviolet light having an extremely short wavelength of several nanometers to several tens of nanometers. In the light exposure by extreme ultraviolet light, the resolution is high and the focus depth is large. For these reasons, the channel length L of the transistor to be formed later can be in the range of 10 nm to 1000 nm inclusive, and the circuit can operate at higher speed.

In order to reduce the number of photomasks used in a photolithography step and reduce the number of steps, an etching step may be performed with the use of a multi-tone mask which is a light-exposure mask through which light is transmitted to have a plurality of intensities. A resist mask formed with use of a multi-tone mask has a plurality of thicknesses and further can be changed in shape by etching; therefore, the resist mask can be used in a plurality of etching steps for processing into different patterns. Therefore, a resist mask corresponding to at least two or more kinds of different patterns can be formed with one multi-tone mask. Thus, the number of light-exposure masks can be reduced and the number of corresponding photolithography steps can be also reduced, whereby simplification of a process can be realized.

Note that when the conductive film is etched, the optimum etching condition is desirably made so that the oxide semiconductor layer 531 can be prevented to be etched together with the conductive film and divided. However, it is difficult to attain such a condition that only the conductive film is etched and the oxide semiconductor layer 531 is not etched at all. In etching of the conductive film, the oxide semiconductor layer 531 is partly etched in some cases, whereby the oxide semiconductor layer having a groove portion (a depressed portion) is formed.

Next, by plasma treatment using a gas such as $N_2O$, $N_2$, or Ar, water or the like adsorbed to a surface of an exposed portion of the oxide semiconductor layer may be removed. In the case where the plasma treatment is performed, the insulating layer 516 which serves as a protective insulating film in contact with part of the oxide semiconductor layer is formed without exposure to the air.

The insulating layer 516 can be formed to a thickness of at least 1 nm by a method by which an impurity such as water or hydrogen does not enter the insulating layer 516, such as a sputtering method as appropriate. When hydrogen is contained in the insulating layer 516, the hydrogen enters the oxide semiconductor layer or extracts oxygen from the oxide semiconductor layer, which causes a reduction in resistance of a back channel of the oxide semiconductor layer (i.e., makes an n-type back channel), so that a parasitic channel might be formed. Therefore, it is important for the insulating layer 516 that hydrogen is not used in a formation method in order to contain hydrogen as little as possible.

In this embodiment, a silicon oxide film is formed to a thickness of 200 nm as the insulating layer 516 by a sputtering method. The substrate temperature in film formation may be higher than or equal to room temperature and lower than or equal to 300° C. and in this embodiment, is 100° C. The silicon oxide film can be formed by a sputtering method in a rare gas (typically argon) atmosphere, an oxygen atmosphere, or a mixed atmosphere containing a rare gas and oxygen. As a target, a silicon oxide target or a silicon target may be used. For example, the silicon oxide film can be formed using a silicon target by a sputtering method in an atmosphere containing oxygen. As the insulating layer 516 which is formed in contact with the oxide semiconductor layer, an inorganic insulating film which does not include an impurity such as moisture, a hydrogen ion, or $OH^-$ and blocks the entry of the impurity from the outside is used. Typically, a silicon oxide film, a silicon oxynitride film, an aluminum oxide film, an aluminum oxynitride film, or the like is used.

As in the case of formation of the oxide semiconductor film 530, an adsorption-type vacuum pump (such as a cryopump) is preferably used in order to remove remaining moisture in a deposition chamber of the insulating layer 516. When the insulating layer 516 is deposited in the deposition chamber which is evacuated with use of a cryopump, the concentration of an impurity contained in the insulating layer 516 can be reduced. Alternatively, the evacuation unit used for removal of the remaining moisture in the deposition chamber may be a turbo pump provided with a cold trap.

It is preferable that a high-purity gas from which impurities such as hydrogen, water, a hydroxyl group, or a hydride have been removed be used as a sputtering gas used for forming the insulating layer 516.

Next, second heat treatment is performed in an inert gas atmosphere or an oxygen gas atmosphere (preferably at from 200° C. to 400° C., e.g. 250° C. to 350° C. inclusive). For example, the second heat treatment is performed in a nitrogen atmosphere at 250° C. for one hour. The second heat treatment is performed in such a condition that part (a channel formation region) of the oxide semiconductor layer is in contact with the insulating layer 516.

As described above, an impurity such as hydrogen, moisture, a hydroxyl group, or a hydride (also referred to as a hydrogen compound) is intentionally removed from the oxide semiconductor layer by subjecting the oxide semiconductor layer to the first heat treatment, and then oxygen which is one of main components of the oxide semiconductor can be supplied by the second heat treatment because oxygen has been reduced in the step of removing impurities. Through the above steps, the oxide semiconductor layer is highly purified and is made to be an electrically i-type (intrinsic) semiconductor. Note that the hydrogen concentration in the highly-purified oxide semiconductor layer 304*a* and the second oxide semiconductor layer 306*a* is $5\times10^{19}$ atoms/cm$^3$ or less, preferably $5\times10^{18}$ atoms/cm$^3$ or less, more preferably $5\times10^{17}$ atoms/cm$^3$ or less. Note that the above hydrogen concentration of the oxide semiconductor film is measured by secondary ion mass spectrometry (SIMS).

Figure 10D:
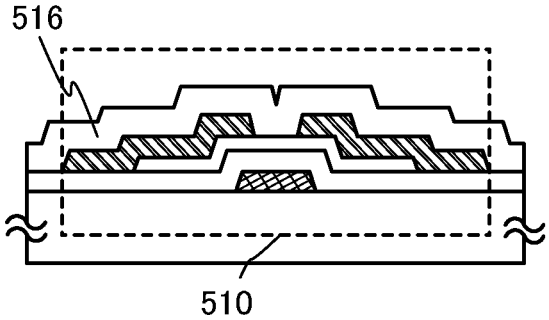
Figure 10E:
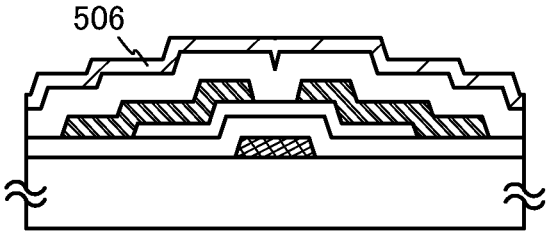

Through the above process, the transistor 510 is formed (see FIG. 10D).

When a silicon oxide layer having a lot of defects is used as the insulating layer 516, an impurity such as hydrogen, moisture, a hydroxyl group, or a hydride contained in the oxide semiconductor layer can be diffused into the insulating layer 516 by the heat treatment which is performed after the formation of the silicon oxide layer, so that impurities in the oxide semiconductor layer can be further reduced.

A protective insulating layer 506 may be formed over the insulating layer 516. For example, a silicon nitride film is formed by an RF sputtering method. Since an RF sputtering method has high productivity, it is a preferable method used for formation of the protective insulating layer. As the protective insulating layer, an inorganic insulating film which does not include an impurity such as moisture and blocks entry of the impurity from the outside, e.g., a silicon nitride film, an aluminum nitride film, or the like is used. In this embodiment, the protective insulating layer 506 is formed using a silicon nitride film (see FIG. 10E).

In this embodiment, as the protective insulating layer 506, a silicon nitride film is formed by heating the substrate 505 over which the steps up to and including the formation step of the insulating layer 516 have been done, to a temperature of 100° C. to 400° C., introducing a sputtering gas including high-purity nitrogen from which hydrogen and moisture are removed, and using a silicon semiconductor target. In that case also, it is preferable that remaining moisture be removed from a deposition chamber in the formation of the protective insulating layer 506 as in the case of the insulating layer 516.

After the formation of the protective insulating layer, heat treatment may be further performed at a temperature from 100° C. to 200° C. inclusive in the air for 1 hour to 30 hours inclusive. This heat treatment may be performed at a fixed heating temperature. Alternatively, the following change in the heating temperature may be conducted plural times repeatedly: the heating temperature is increased from room temperature to a temperature of 100° C. to 200° C. inclusive and then decreased to room temperature.

As described above, a transistor which is fabricated in a manner illustrated in this embodiment includes a highly-purified oxide semiconductor layer. Accordingly, an electrical signal such as an image signal can be held for a longer period in the pixel, and a writing interval can be set longer. Therefore, the cycle of one frame period can be set longer, and the frequency of refresh operations in a still image display period can be reduced, whereby an effect of suppressing power consumption can be further increased. In addition, a highly-purified oxide semiconductor layer is preferably used because such a layer can be manufactured without a process such as leaser irradiation and can realize formation of a transistor over a large substrate.

This embodiment can be implemented by combination with structures described in the other embodiments as appropriate.

Embodiment 6

A liquid crystal display device disclosed in this specification can be applied to a variety of electronic appliances (including game machines). Examples of electronic appliances are a television set (also referred to as a television or a television receiver), a monitor of a computer or the like, a camera such as a digital camera or a digital video camera, a digital photo frame, a mobile phone handset (also referred to as a mobile phone or a mobile phone device), a portable game machine, a portable information terminal, an audio reproducing device, a large-sized game machine such as a pachinko machine, and the like. Examples of electronic devices each including the liquid crystal display device described in the above embodiment are described.

Figure 11A:
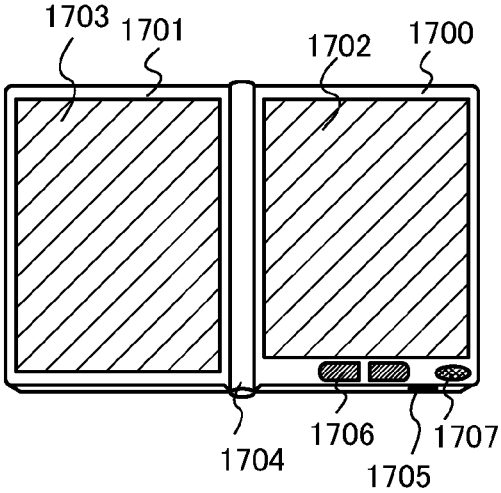
FIGS. 11A to 11D each illustrate an electronic device of one embodiment of the present invention.

FIG. 11A illustrates an example of an e-book reader. The e-book reader illustrated in FIG. 11A includes two housings, a housing 1700 and a housing 1701. The housing 1700 and the housing 1701 are combined with a hinge 1704 so that the e-book reader can be opened and closed. With such a structure, the e-book reader can be operated like a paper book.

A display portion 1702 and a display portion 1703 are incorporated in the housing 1700 and the housing 1701, respectively. The display portion 1702 and the display portion 1703 may be configured to display one image or different images. In the case where the display portion 1702 and the display portion 1703 display different images, for example, a display portion on the right side (the display portion 1702 in FIG. 11A) can display text and a display portion on the left side (the display portion 1703 in FIG. 11A) can display graphics.

FIG. 11A illustrates an example in which the housing 1700 is provided with an operation portion and the like. For example, the housing 1700 is provided with a power supply input terminal 1705, an operation key 1706, a speaker 1707, and the like. With the operation key 1706, pages can be turned. Note that a keyboard, a pointing device, or the like may be provided on the surface of the housing, on which the display portion is provided. Further, an external connection terminal (an earphone terminal, a USB terminal, a terminal that can be connected to various cables such as a USB cable, or the like), a recording medium insert portion, or the like may be provided on the back surface or the side surface of the housing. Further, a function of an electronic dictionary may be provided for the e-book reader illustrated in FIG. 11A.

Figure 11B:
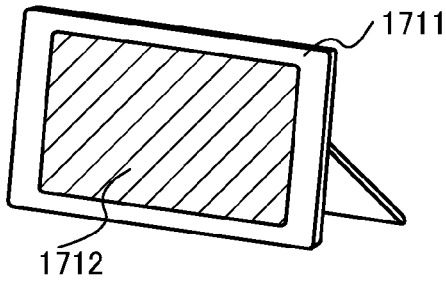

FIG. 11B illustrates an example of a digital photo frame including a liquid crystal display device. For example, in the digital photo frame illustrated in FIG. 11B, a display portion 1712 is incorporated in a housing 1711. The display portion 1712 can display various images. For example, the display portion 1712 can display data of an image taken with a digital camera or the like and function as a normal photo frame.

Note that the digital photo frame illustrated in FIG. 11B may be provided with an operation portion, an external connection terminal (a USB terminal, a terminal which can be connected to a variety of cables such as a USB cable, and the like), a recording medium insertion portion, and the like. Although these components may be provided on the surface on which the display portion is provided, it is preferable to provide them on the side surface or the back surface for the design of the digital photo frame. For example, a memory storing data of an image taken with a digital camera is inserted in the recording medium insertion portion of the digital photo frame, whereby the image data can be transferred and then displayed on the display portion 1712.

Figure 11C:
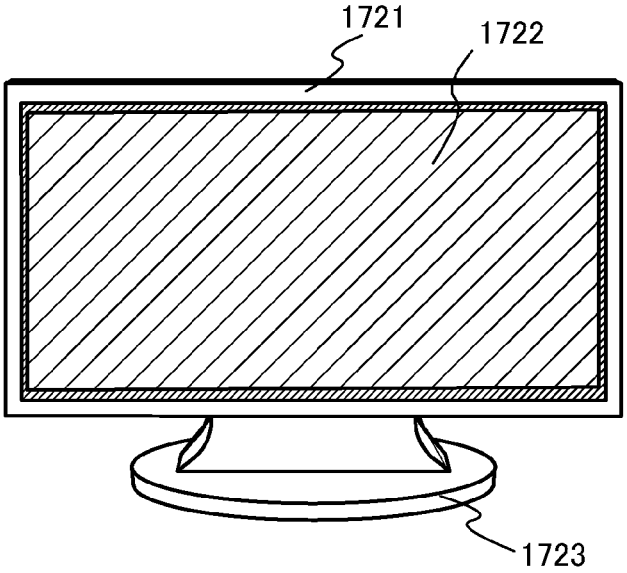

FIG. 11C illustrates an example of a television set including a liquid crystal display device. In the television set illustrated in FIG. 11C, a display portion 1722 is incorporated in a housing 1721. The display portion 1722 can display an image. Further, the housing 1721 is supported by a stand 1723 here. The liquid crystal display device described in any of the above embodiments can be used in the display portion 1722.

The television set illustrated in FIG. 11C can be operated with an operation switch of the housing 1721 or a separate remote controller. Channels and volume can be controlled with an operation key of the remote controller so that an image displayed on the display portion 1722 can be controlled. Further, the remote controller may be provided with a display portion for displaying data output from the remote controller.

Figure 11D:
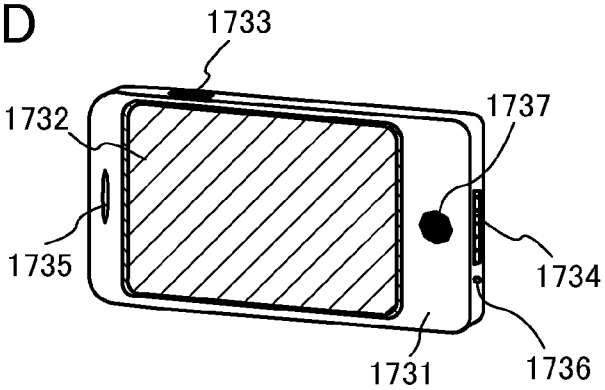

FIG. 11D illustrates an example of a mobile phone including a liquid crystal display device. The mobile phone handset illustrated in FIG. 11D is provided with a display portion 1732 incorporated in a housing 1731, an operation button 1733, an operation button 1737, an external connection port 1734, a speaker 1735, a microphone 1736, and the like.

The display portion 1732 of the mobile phone handset illustrated in FIG. 11D is a touch panel. By touching the display portion 1732 with a finger or the like, contents displayed on the display portion 1732 can be controlled. Further, operations such as making calls and texting can be performed by touching the display portion 1732 with a finger or the like.

This embodiment can be implemented in appropriate combination with the structures described in the other embodiments.

Embodiment 7

In this embodiment, a structure of the e-book reader illustrated in above Embodiment 6 is described with a specific example illustrated.

Figure 12A:
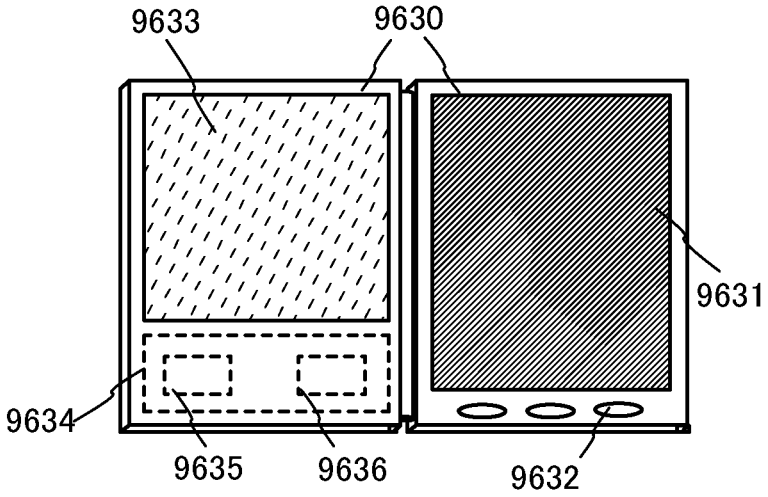
FIGS. 12A and 12B illustrate an e-book reader of one embodiment of the present invention.

FIG. 12A illustrates an e-book reader (also referred to as an e-book reader) which can include housings 9630, a display portion 9631, operation keys 9632, a solar battery 9633, and a charge and discharge control circuit 9634. The e-book reader illustrated in FIG. 12A can have various functions such as a function of displaying various kinds of information (e.g., a still image, a moving image, and a text image); a function of displaying a calendar, a date, a time, and the like on the display portion; a function of operating or editing the information displayed on the display portion; and a function of controlling processing by various kinds of software (programs). Note that in FIG. 12A, a structure including a battery 9635 and a DCDC converter (hereinafter abbreviated as a converter 9636) is illustrated as an example of the charge and discharge control circuit 9634.

In the case of using the liquid crystal display device in above Embodiments as the display portion 9631 in the structure illustrated in FIG. 12A, the electronic book reader may be used in a comparatively bright environment. In that case, power generation by the solar battery 9633 and charge by the battery 9635 can be effectively performed, which is preferable. Note that a structure in which the solar battery 9633 is provided on each of a surface and a rear surface of the housing 9630 is preferable in order to charge the battery 9635 efficiently. When a lithium ion battery is used as the battery 9635, there is an advantage of downsizing or the like.

Figure 12B:
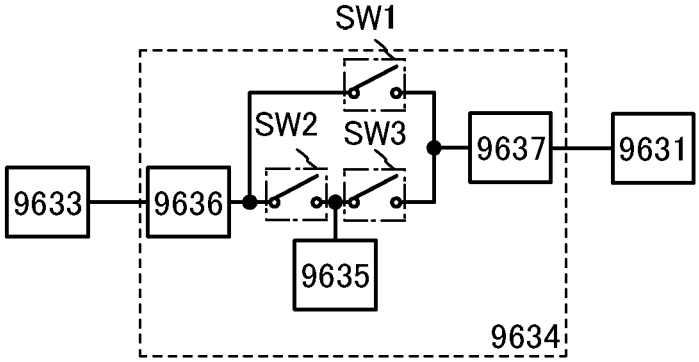

The structure and the operation of the charge and discharge control circuit 9634 illustrated in FIG. 12A are described with reference to a block diagram in FIG. 12B. The solar battery 9633, the battery 9635, the converter 9636, a converter 9637, switches SW1 to SW3, and the display portion 9631 are shown in FIG. 12B, and the battery 9635, the converter 9636, the converter 9637, and the switches SW1 to SW3 correspond to the charge and discharge control circuit 9634.

First, an example of operation in the case where power is generated by the solar battery 9633 using external light is described. The voltage of power generated by the solar battery is raised or lowered by the converter 9636 so that the power has a voltage for charging the battery 9635. Then, when the power from the solar battery 9633 is used for the operation of the display portion 9631, the switch SW1 is turned on and the voltage of the power is raised or lowered by the converter 9637 so as to be a voltage needed for the display portion 9631. In addition, when display on the display portion 9631 is not performed, the switch SW1 is turned off and the switch SW2 is turned on so that charge of the battery 9635 may be performed.

Next, operation in the case where power is not generated by the solar battery 9633 using external light is described. The voltage of power accumulated in the battery 9635 is raised or lowered by the converter 9637 by turning on the switch SW3. Then, power from the battery 9635 is used for the operation of the display portion 9631.

Note that although the solar battery 9633 is described as an example of a means for charge, charge of the battery 9635 may be performed with another means. In addition, a combination of the solar battery 9633 and another means for charge may be used.

This embodiment can be implemented in appropriate combination with the structures described in the other embodiments.

This application is based on Japanese Patent Application serial no. 2010-090657 filed with Japan Patent Office on Apr. 9, 2010, the entire contents of which are hereby incorporated by reference.

What is claimed is:

1. A liquid crystal display device comprising:

a display panel;

a backlight portion including a first light source for emitting light of a plurality of colors and a second light source for emitting white light;

an image switching circuit configured to determine whether display is performed in a moving-image mode or a still-image mode in accordance with an image signal from the outside of the liquid crystal display device; and a driving control circuit configured to control the backlight portion and the display panel, wherein in the moving-image mode, the driving control circuit controls the backlight portion to emit light from the first light source and to switch a color of the light corresponding to any one of the plurality of colors per a predetermined period and controls the display panel by writing the image signal for each of the plurality of colors per the predetermined period, so that a color image is perceived with a mixed color of the plurality of colors of the first light source, and wherein in the still-image mode, the driving control circuit controls the backlight portion to keep the second light source emitting light and controls the display panel to hold the image signal written thereto, for a predetermined period, so that a monochrome image is perceived.

2. The liquid crystal display device according to claim 1, wherein the first light source includes a light source emitting red light, a light source emitting green light, and a light source emitting blue light, and the second light source includes a light source emitting white light.

3. The liquid crystal display device according to claim 1, wherein the first light source includes a light source emitting red light, a light source emitting green light, and a light source emitting blue light, and the second light source includes the light source emitting blue light and a light source emitting yellow light.

4. The liquid crystal display device according to claim 1, wherein the first light source includes a light source emitting red light, a light source emitting green light, and a light source emitting blue light, and the second light source includes a light source emitting cyan light and the light source emitting red light or a light source emitting magenta light and the light source emitting green light.

5. The liquid crystal display device according to claim 1, wherein the first light source and the second light source comprise light-emitting diodes.

6. An electronic device including the liquid crystal display device according to claim 1.

7. A liquid crystal display device comprising:

a display panel including a plurality of pixels each including a pixel electrode for controlling alignment of liquid crystal, and a transistor connected to the pixel electrode, a backlight portion including a first light source for emitting light of a plurality of colors and a second light source for emitting white light;

an image switching circuit configured to determine whether display is performed in a moving-image mode or a still-image mode in accordance with an image signal from the outside of the liquid crystal display device; and a driving control circuit configured to control the backlight portion and the display panel, wherein in the moving-image mode, the driving control circuit controls the backlight portion to emit light from the first light source and to switch a color of the light corresponding to any one of the plurality of colors per a predetermined period and controls the display panel by writing the image signal for each of the plurality of colors per the predetermined period, so that a color image is perceived with a mixed color of the plurality of colors of the first light source, and wherein in the still-image mode, the driving control circuit controls the backlight portion to keep the second light source to emit light and controls the display panel to hold the image signal written thereto, for a predetermined period, so that a monochrome image is perceived.

8. The liquid crystal display device according to claim 7, wherein the transistor includes an oxide semiconductor layer.

9. The liquid crystal display device according to claim 7, wherein the first light source includes a light source emitting red light, a light source emitting green light, and a light source emitting blue light, and the second light source includes a light source emitting white light.

10. The liquid crystal display device according to claim 7, wherein the first light source includes a light source emitting red light, a light source emitting green light, and a light source emitting blue light, and the second light source includes the light source emitting blue light and a light source emitting yellow light.

11. The liquid crystal display device according to claim 7, wherein the first light source includes a light source emitting red light, a light source emitting green light, and a light source emitting blue light, and the second light source includes a light source emitting cyan light and the light source emitting red light or a light source emitting magenta light and the light source emitting green light.

12. The liquid crystal display device according to claim 7, wherein the first light source and the second light source comprise light-emitting diodes.

13. An electronic device including the liquid crystal display device according to claim 7.

14. A liquid crystal display device comprising:

a display panel, the display panel comprising:

a plurality of pixels, each including a transistor and a pixel electrode; and a driver circuit configured to drive the plurality of pixels, a backlight portion, the backlight portion comprising:

a first light source for emitting light of a plurality of colors;

a second light source for emitting white light; and a backlight control circuit configured to drive the first light source and the second light source, an image switching circuit, the image switching circuit comprising:

a memory circuit configured to store image signals;

a comparison circuit configured to detect a difference among the image signals of successive frame periods stored in the memory circuit;

a selection circuit configured to select and output the image signals of the successive frame periods in accordance with the difference detected in the comparison circuit; and a display control circuit configured to output the image signals output from the selection circuit and a first signal; and a driving control circuit configured to control the display panel and the backlight portion in accordance with the first signal, wherein the driving control circuit controls the backlight control circuit so that the first light source emits light by the light of the plurality of colors sequentially, in case the comparison circuit detects the difference, and wherein the driving control circuit controls the backlight control circuit so that the second light source emits the white light in case the comparison circuit does not detect the difference.

15. The liquid crystal display device according to claim 14, wherein the transistor includes an oxide semiconductor layer.

16. The liquid crystal display device according to claim 14, wherein the first light source includes a light source emitting red light, a light source emitting green light, and a light source emitting blue light, and the second light source includes a light source emitting white light.

17. The liquid crystal display device according to claim 14, wherein the first light source includes a light source emitting red light, a light source emitting green light, and a light source emitting blue light, and the second light source includes the light source emitting blue light and a light source emitting yellow light.

18. The liquid crystal display device according to claim 14, wherein the first light source includes a light source emitting red light, a light source emitting green light, and a light source emitting blue light, and the second light source includes a light source emitting cyan light and the light source emitting red light or a light source emitting magenta light and the light source emitting green light.

19. The liquid crystal display device according to claim 14, wherein the first light source and the second light source comprise light-emitting diodes.

20. An electronic device including the liquid crystal display device according to claim 14.

21. A liquid crystal display device comprising:

a display panel, the display panel comprising:

a plurality of pixels, each including a transistor and a pixel electrode; and a driver circuit configured to drive the plurality of pixels, a backlight portion, the backlight portion comprising:

a first light source for emitting light of a first color;

a second light source for emitting light of a second color;

a third light source for emitting light of a third color;

a fourth light source for emitting light of a fourth color; and a backlight control circuit configured to drive the first light source, the second light source, the third light source and the fourth light source, an image switching circuit, the image switching circuit comprising:

a memory circuit configured to store image signals;

a comparison circuit configured to detect a difference among the image signals of successive frame periods stored in the memory circuit;

a selection circuit configured to select and output the image signals of the successive frame periods in accordance with the difference detected in the comparison circuit; and a display control circuit configured to output a signal and the image signals output from the selection circuit; and a driving control circuit configured to control the display panel and the backlight portion in accordance with the signal from the display control circuit, wherein the driving control circuit controls the backlight control circuit so that the first light source, the second light source and the third light source are sequentially lit, in case the comparison circuit detects the difference, and wherein the driving control circuit controls the backlight control circuit so that the fourth light source and any one of the first light source, the second light source and the third light source are lit at the same time, in case the comparison circuit does not detect the difference.

22. The liquid crystal display device according to claim 21, wherein the transistor includes an oxide semiconductor layer.

23. The liquid crystal display device according to claim 21, wherein the fourth color is a complementary color of any one of the first color, the second color, and the third color.

24. The liquid crystal display device according to claim 21, wherein the first color is red, the second color is green and the third color is blue, and wherein the fourth color is any one of cyan, magenta and yellow.

* * * * *